US010612182B2

(12) United States Patent
Del Pos et al.

(10) Patent No.: US 10,612,182 B2
(45) Date of Patent: Apr. 7, 2020

(54) LAUNDRY WASHING MACHINE

(71) Applicant: Electrolux Appliances Aktiebolag, Stockholm (SE)

(72) Inventors: Maurizio Del Pos, Pordenone (IT); Daniele Favaro, Venice (IT); Andrea Zattin, Solesino (IT)

(73) Assignee: Electrolux Appliances Aktiebolag (SE)

( * ) Notice: Subject to any disclaimer, the term of this patent is extended or adjusted under 35 U.S.C. 154(b) by 23 days.

(21) Appl. No.: 15/528,388

(22) PCT Filed: Nov. 20, 2014

(86) PCT No.: PCT/EP2014/075147
§ 371 (c)(1),
(2) Date: May 19, 2017

(87) PCT Pub. No.: WO2016/078714
PCT Pub. Date: May 26, 2016

(65) Prior Publication Data

US 2017/0321369 A1 Nov. 9, 2017

(51) Int. Cl.

| | |
|---|---|
| ***D06F 39/02*** | (2006.01) |
| ***D06F 39/00*** | (2020.01) |
| ***D06F 39/08*** | (2006.01) |

(52) U.S. Cl.
CPC ..... *D06F 39/028* (2013.01); *D06F 39/007* (2013.01); *D06F 39/02* (2013.01); *D06F 39/088* (2013.01)

(58) Field of Classification Search
CPC ..... D06F 39/02; D06F 39/022; D06F 39/028; D06F 39/007
See application file for complete search history.

(56) References Cited

U.S. PATENT DOCUMENTS

| | | | |
|---|---|---|---|
| 6,557,382 | B1 | 5/2003 | Koike et al. |
| 2014/0157835 | A1 | 6/2014 | Del Pos et al. |

(Continued)

FOREIGN PATENT DOCUMENTS

| | | | |
|---|---|---|---|
| DE | 3520202 | A1 | 12/1986 |
| EP | 1085118 | A2 | 3/2001 |

(Continued)

OTHER PUBLICATIONS

International Search Report dated Mar. 23, 2015 in corresponding International Application No. PCT/EP2014/075147.

(Continued)

*Primary Examiner* — Joseph L. Perrin
(74) *Attorney, Agent, or Firm* — RatnerPrestia

(57) ABSTRACT

A laundry washing machine includes at least one drawer which is fitted/inserted in extractable manner into a corresponding substantially basin-shaped, drawer housing, which is located/recessed inside the outer casing, and is movable in a substantially horizontally-oriented, displacement direction (d) between a retracted position in which the drawer is almost completely recessed into the outer casing, and an extracted position in which the drawer partly juts out from the outer casing. The drawer in turn includes: a drawer-like supporting structure having a substantially basin-shaped, regeneration-agent compartment structured for being manually fillable with a given amount of regeneration agent, and a manually openable, lid assembly, which is fitted on the drawer-like supporting structure, on top of the regeneration-agent compartment, and is structured to selectively close/cover the upper mouth of the regeneration-agent compartment.

22 Claims, 11 Drawing Sheets

(56) References Cited

U.S. PATENT DOCUMENTS

| | | | |
|---|---|---|---|
| 2014/0157836 | A1 | 6/2014 | Zattin et al. |
| 2014/0165665 | A1 | 6/2014 | Del Pos et al. |
| 2014/0165666 | A1 | 6/2014 | Del Pos et al. |
| 2015/0107309 | A1 | 4/2015 | Favaro et al. |
| 2015/0107310 | A1 | 4/2015 | Del Pos et al. |
| 2015/0204005 | A1 | 7/2015 | Favaro et al. |
| 2017/0362763 | A1 | 12/2017 | Favaro et al. |

FOREIGN PATENT DOCUMENTS

| | | | | |
|---|---|---|---|---|
| EP | 2554736 | A1 | 2/2013 | |
| EP | 2554738 | A1 * | 2/2013 | ..... D06F 39/007 |
| EP | 2562303 | A2 | 2/2013 | |
| EP | 2657389 | A1 | 10/2013 | |
| EP | 2679716 | A1 | 1/2014 | |
| EP | 2733249 | A2 | 5/2014 | |
| WO | 2013045299 | A1 | 4/2013 | |
| WO | 2013098068 | A1 | 7/2013 | |
| WO | 2013160211 | A1 | 10/2013 | |
| WO | 2014121820 | A1 | 8/2014 | |
| WO | 2014121830 | A1 | 8/2014 | |

OTHER PUBLICATIONS

International Search Report dated Dec. 22, 2014 in related International Application No. PCT/EP2014/075171.

International Search Report dated Mar. 27, 2015 in related International Application No. PCT/EP2014/075178.

Final Office Action for U.S. Appl. No. 15/528,386, dated Feb. 4, 2019—14 pages.

Non Final Office Actionn for U.S. Appl. No. 15/528,386, dated Sep. 17, 2018, 16 pages.

Notice of Allowance for U.S. Appl. No. 15/528,383, dated Aug. 7, 2019, 8 pages.

Non Final Office Action for U.S. Appl. No. 15/528,383, dated May 28, 2019, 20 pages.

Non Final Office Action for U.S. Appl. No. 15/528,386, dated Jun. 12, 2019, 17 pages.

Notice of Allowance for U.S. Appl. No. 15/528,386, dated Nov. 12, 2019, 17 pages.

* cited by examiner

LAUNDRY WASHING MACHINE

BACKGROUND

The present invention relates to a laundry washing machine.

More in particular, the present invention relates to a front-loading home laundry washing machine, to which the following description refers purely by way of example without this implying any loss of generality.

As is known, a front-loading home laundry washing machine generally comprises: a substantially parallelepiped-shaped outer boxlike casing structured for resting on the floor; a substantially horizontally-oriented and approximately cylindrical washing tub which is usually suspended in floating manner inside the casing, with the front mouth directly facing a laundry loading/unloading through opening realized in the front wall of the casing; a substantially cylindrical, cup-shaped rotatable drum structured for housing the laundry to be washed, and which is fitted inside the washing tub with the concavity facing the laundry loading/unloading opening, and is supported by the washing tub in axially rotatable manner so as to be able to freely rotate inside the washing tub about its substantially horizontally-oriented, longitudinal axis; a substantially cylindrical, elastically-deformable bellows which watertight connects the front mouth of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; and an electrically-powered motor assembly which is structured for driving into rotation the rotatable drum about its longitudinal axis inside the washing tub.

This type of laundry washing machine furthermore comprises: a detergent dispenser which is located inside the boxlike casing, immediately above the washing tub, and is structured for selectively feeding into the washing tub, according to the washing cycle manually-selected by the user, a given amount of detergent, softener and/or other washing agent suitably mixed with fresh-water arriving from the water mains; a fresh-water supply circuit which is structured for selectively drawing fresh water from the water mains according to the washing cycle manually-selected by the user, and channelling said fresh-water to the detergent dispenser or directly to the washing tub; and finally an appliance control panel which is generally located on the front wall of the casing, above the laundry loading/unloading opening, and is structured for allowing the user to manually select the desired washing-cycle.

In addition to the above, high-end front-loading laundry washing machines may optionally have an internal water softening device which is located along the fresh-water supply circuit, and is structured to selectively reduce the hardness degree of the tap water channelled towards the detergent dispenser and the washing tub. The use of softened water during the washing cycle, in fact, significantly improves cleaning performances.

More in detail, the water softening device is generally internally provided with a given amount of ion-exchange resins which are capable of restraining the calcium and magnesium ions (Ca++ and Mg++) dissolved in the water flowing through the same water softening device, so as to reduce the hardness degree of the tap water directed towards the detergent dispenser and the washing tub.

In addition to the above, since the water softening capabilities of the ion-exchange resins are used to quickly drop away after a limited number of washing cycles, this high-end laundry washing machines are generally provided with an internal reservoir of salt (NaCl) to be used for selectively producing some brine (i.e. salt water) which is periodically channeled into the water softening device to regenerate the ion-exchange resins located therein. Salt water, in fact, is able to remove from the ion-exchange resins the calcium and magnesium ions previously combined/fixed to said resins.

In European patent No. 2554736 the salt to be used in the regeneration process of the ion-exchange resins is stowed into a specific drawer which is fitted/inserted in manually extractable manner into a corresponding drawer housing which is located inside the casing, above the washing tub and horizontally adjoining the drawer housing that accommodates the detergent drawer of the detergent dispenser, so that the entrances of the two drawer housings are arranged one immediately beside the other, on the upper left corner of the front wall of the casing, horizontally aligned to the appliance control panel.

Despite offering an extremely easy and speedy manual loading of both salt and detergents into the laundry washing machine, the arrangement of salt drawer and detergent drawer one beside the other has some drawbacks.

In fact, when both drawers are in the extracted position one adjacent the other, the user may unintentionally pour some detergent, softener or other washing agent into the salt drawer, or may unintentionally pour some salt into the detergent drawer. In first case, a contaminated brine is subsequently channeled into the water softening device jeopardizing the softening capabilities of ion-exchange resins. In second case, a mixture of salt, detergent and water is subsequently channeled into the washing tub causing the quick rusting up of all metal parts coming into contact with the washing water.

SUMMARY OF SELECTED INVENTIVE ASPECTS

An aim of the present invention is to eliminate the drawbacks referred above.

In compliance with the above aims, according to an aspect of the present invention there is provided a laundry washing machine comprising an outer casing and, inside said outer casing, a washing tub, a rotatable drum housed in axially rotatable manner inside the washing tub and structured for housing the laundry to be washed, a detergent dispenser which is structured for supplying detergent into the washing tub, a fresh-water supply circuit which is structured for selectively channelling a flow of fresh water from the water mains towards the detergent dispenser and/or the washing tub, and an internal water softening device capable of reducing the hardness degree of the fresh directed towards the detergent dispenser or the washing tub;

the laundry washing machine furthermore comprising at least a first drawer which is fitted/inserted in extractable manner into a corresponding drawer housing located/recessed inside the outer casing, and is movable in a displacement direction between a retracted position in which said first drawer is almost completely recessed into the outer casing, and an extracted position in which said first drawer partly juts out from the outer casing;

the laundry washing machine being characterized in that said first drawer comprises: a drawer-like supporting structure having a substantially basin-shaped, regeneration-agent compartment structured for being manually fillable with a given amount of consumable salt or other regeneration agent; and a manually openable, upper lid assembly which is fitted on the mouth of said regeneration-agent compartment so as to move together with said drawer-like supporting structure, and is structured to selectively close/cover the upper mouth of said regeneration-agent compartment.

Preferably, though not necessarily, the laundry washing machine is furthermore characterized in that the entrance of said drawer housing is located on a first portion of a front wall of said outer casing, and in that the laundry washing machine additionally comprises an appliance control panel which is located on a second portion of said front wall substantially horizontally aligned beside said first portion.

Preferably, though not necessarily, the laundry washing machine is furthermore characterized in that said appliance control panel is stationary on said front wall.

Preferably, though not necessarily, the laundry washing machine is furthermore characterized in that said lid assembly is fitted on the drawer-like supporting structure, on top of the regeneration-agent compartment.

Preferably, though not necessarily, the laundry washing machine is furthermore characterized in that said lid assembly is structured to receive, at least when said first drawer is placed in the retracted position, a flow of fresh-water and to channel said fresh-water into the beneath-located regeneration-agent compartment.

Preferably, though not necessarily, the laundry washing machine is furthermore characterized in that said lid assembly is structured to spread out the received fresh-water inside the regeneration-agent compartment.

Preferably, though not necessarily, the laundry washing machine is furthermore characterized in that said lid assembly is provided with a water inlet which is structured to allow the fresh-water to enter into the same lid assembly, and with one or more water outlets which fluidically communicate with said water inlet and are structured to allow the water entering into the lid assembly through the water inlet to come out of the lid assembly and fall into the beneath-located regeneration-agent compartment.

Preferably, though not necessarily, the laundry washing machine is furthermore characterized by comprising a water-supply line which is structured to selectively channel, at least when said first drawer is placed in the retracted position, the fresh-water of the water mains towards the water inlet of said lid assembly.

Preferably, though not necessarily, the laundry washing machine is furthermore characterized in that the water inlet of the lid assembly is structured to couple in detachable manner with said water-supply line when said first drawer is placed in the retracted position.

Preferably, though not necessarily, the laundry washing machine is furthermore characterized in that the water inlet of said lid assembly comprises a first hydraulic connector structured to couple in detachable manner with a complementary second hydraulic connector stationary inside the drawer housing when said first drawer is placed in the retracted position, and to uncouple from said second hydraulic connector when said first drawer moves into an extracted position; said complementary second hydraulic connector communicating with said water-supply line.

Preferably, though not necessarily, the laundry washing machine is furthermore characterized in that said lid assembly comprises: a frame member which is structured to fit to the upper rim of regeneration-agent compartment; and a manually-movable trapdoor which is movably coupled to the frame member so as to selectively close a pass-through opening which is delimited by the frame member and is suitably shaped/dimensioned to allow the user to manually pour the consumable salt or other regeneration agent into the regeneration-agent compartment.

Preferably, though not necessarily, the laundry washing machine is furthermore characterized in that the frame member is provided with a water inlet structured for receiving the fresh-water when said first drawer is placed in the retracted position, and with one or more water-delivery portions which are arranged on the lower side of the frame member and are structured to allow the outflow of the fresh-water from the frame member.

Preferably, though not necessarily, the laundry washing machine is furthermore characterized in that the water-delivery portions are arranged on the lower face of the frame member all around the pass-through opening closed by the trapdoor.

Preferably, though not necessarily, the laundry washing machine is furthermore characterized in that the water-delivery portions are structured to pour a shower of water droplets by gravity into the regeneration-agent compartment.

Preferably, though not necessarily, the laundry washing machine is furthermore characterized in that the water inlet of the frame member comprises a first hydraulic connector extends substantially parallel to the displacement direction of the drawer, and is structured to couple in detachable manner, with a complementary second hydraulic connector which is located stationary inside the drawer housing so as to couple, when said first drawer is placed in the retracted position, with said first hydraulic connector.

Preferably, though not necessarily, the laundry washing machine is furthermore characterized in that the drawer-like supporting structure of the first drawer is additionally provided with one or more substantially basin-shaped, detergent compartments which are arranged beside the regeneration-agent compartment and are each structured for being manually fillable with a given amount of detergent, softener or other washing agent.

Preferably, though not necessarily, the laundry washing machine is furthermore characterized in that the detergent dispenser comprises a second drawer which is provided with one or more detergent compartments each structured for being manually fillable with a given amount of detergent, softener or other washing agent, and which is fitted/inserted in extractable manner into a corresponding second drawer housing which is located/recessed inside the outer casing, and is movable in a displacement direction between a retracted position in which the second drawer is recessed into the outer casing, and an extracted position in which second drawer partly juts out from the outer casing to expose said detergent compartments.

Preferably, though not necessarily, the laundry washing machine is furthermore characterized in that the second drawer is arranged horizontally beside the first drawer so that both drawers are independently movable inside the corresponding drawer housings parallel to one another.

Preferably, though not necessarily, the laundry washing machine is furthermore characterized in that the detergent dispenser comprises a drawer flush circuit which is connected to the fresh-water supply circuit, and is structured for selectively pouring the fresh-water of the water mains selectively into any one of the detergent compartments, so as to selectively flush the detergent, softener or other washing agent out of the same detergent compartment and down onto the bottom of the drawer housing.

Preferably, though not necessarily, the laundry washing machine is furthermore characterized in that the drawer flush circuit of the detergent dispenser is additionally structured for selectively channelling the fresh-water of the water mains towards the water inlet of said lid assembly.

Preferably, though not necessarily, the laundry washing machine is furthermore characterized in that said lid assembly is structured to couple in detachable manner with the drawer flush circuit for receiving the fresh-water of the water mains directly from the drawer flush circuit.

Preferably, though not necessarily, the laundry washing machine is furthermore characterized in that the drawer flush circuit of the detergent dispenser comprises: a water delivery member which is structured to form the upper lid of the drawer housing, so as to be located immediately above the detergent compartment/s and the regeneration-agent compartment when said first and/or second drawer/s is/are placed in the retracted position, and is provided with a number of water-delivery portions each suitably structured to allow the outflow of the water from the water delivery member towards the detergent compartment/s or the regeneration-agent compartment; and an electrically-operated, flow-diverter which is connected to the water softening device and/or to the fresh-water supply circuit for receiving the softened or unsoftened fresh-water, and is suitably structured to selectively channel the softened fresh-water arriving from the water softening device or the unsoftened fresh-water arriving from the fresh-water supply circuit, towards any one of the water-delivery portions of the water delivery member.

Preferably, though not necessarily, the laundry washing machine is furthermore characterized in that one of the water-delivery portions of the water delivery member comprises the second hydraulic connector.

Preferably, though not necessarily, the laundry washing machine is furthermore characterized in that the regeneration-agent compartment of the drawer is dimensioned to accommodate an amount of consumable salt or other regeneration agent sufficient for performing one or more regeneration processes of water softening capabilities of the internal water softening device.

Preferably, though not necessarily, the laundry washing machine is furthermore characterized in that the internal water softening device internally contains a given amount of ion-exchange resins capable of restraining the calcium and magnesium ions dissolved in the water that flows through the same water softening device.

BRIEF DESCRIPTION OF THE DRAWINGS

A non-limiting embodiment of the present invention will now be described, by way of example, with reference to the accompanying drawings, in which:

FIG. 15 is a sectioned side view of the detergent drawer shown in FIGS. 10, 11 and 12, with parts removed for clarity; whereas

DETAILED DESCRIPTION OF EXAMPLE EMBODIMENTS

Figure 2:
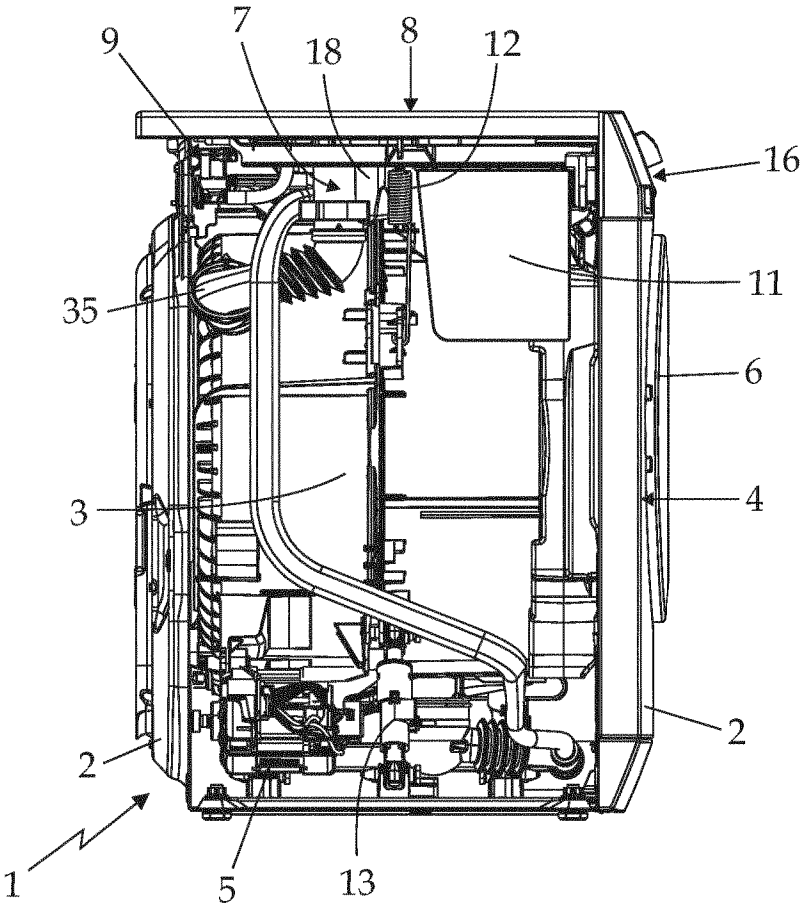
FIG. 2 is a side view of the FIG. 1 laundry washing machine, with parts removed for clarity.
Figure 1:
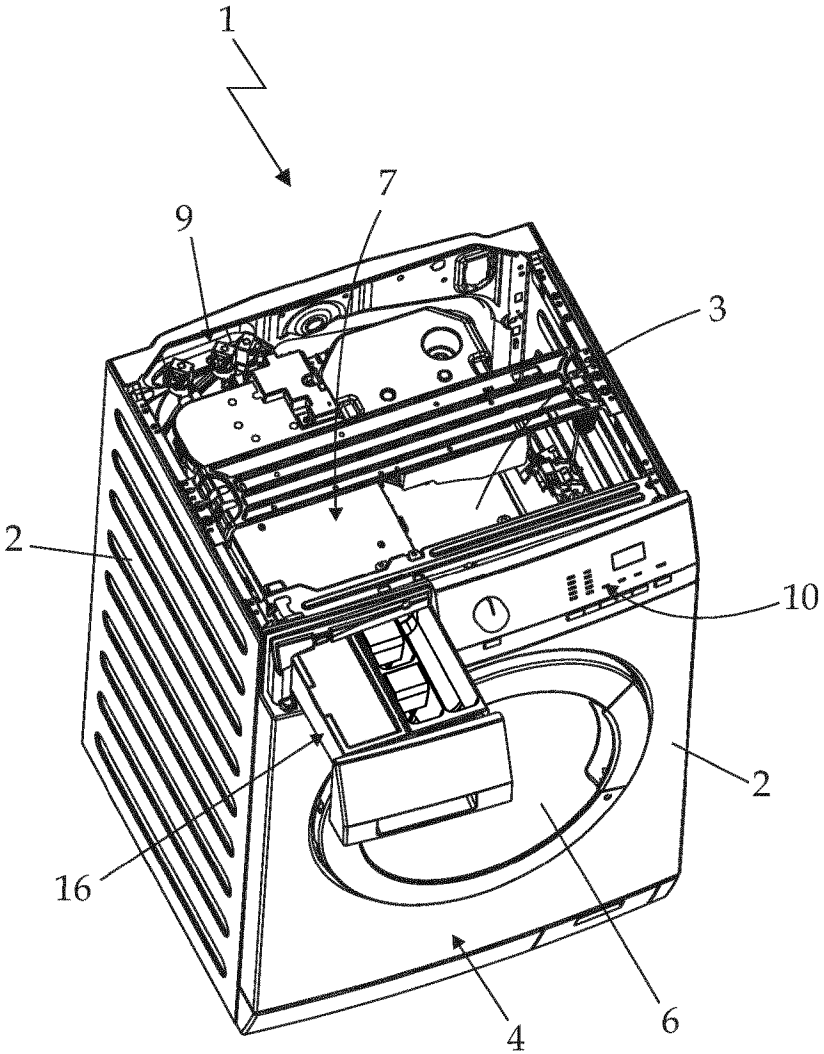
FIG. 1 is a perspective view of a laundry washing machine realized in accordance with the teachings of the present invention, with parts removed for clarity.

With reference to FIGS. 1 and 2, reference number 1 indicates as a whole a laundry washing machine 1 which preferably basically comprises: a preferably substantially parallelepiped-shaped, outer boxlike casing 2 structured for resting on the floor; a preferably substantially horizontally-oriented, approximately cylindrical washing tub 3 which is arranged inside the casing 2 with the mouth directly facing a laundry loading/unloading pass-through opening realized in the front wall 4 of the outer casing 2; a substantially cylindrical, cup-shaped rotatable drum (not shown) which is structured for housing the laundry to be washed, and is fitted in axially rotatable manner inside the washing tub 3 with the concavity facing the front opening or mouth of washing tub 3, so as to be able to freely rotate about its longitudinal axis inside the washing tub 3; an electrically-powered motor assembly 5 which is structured for driving into rotation the rotatable drum (not shown) about its longitudinal axis inside the washing tub 3; and a porthole door 6 which is hinged to the front wall 4 of casing 2 so as to be movable/rotatable to and from a closing position in which the door 6 closes the laundry loading/unloading opening on front wall 4 for watertight sealing the washing tub 4.

Figure 3:
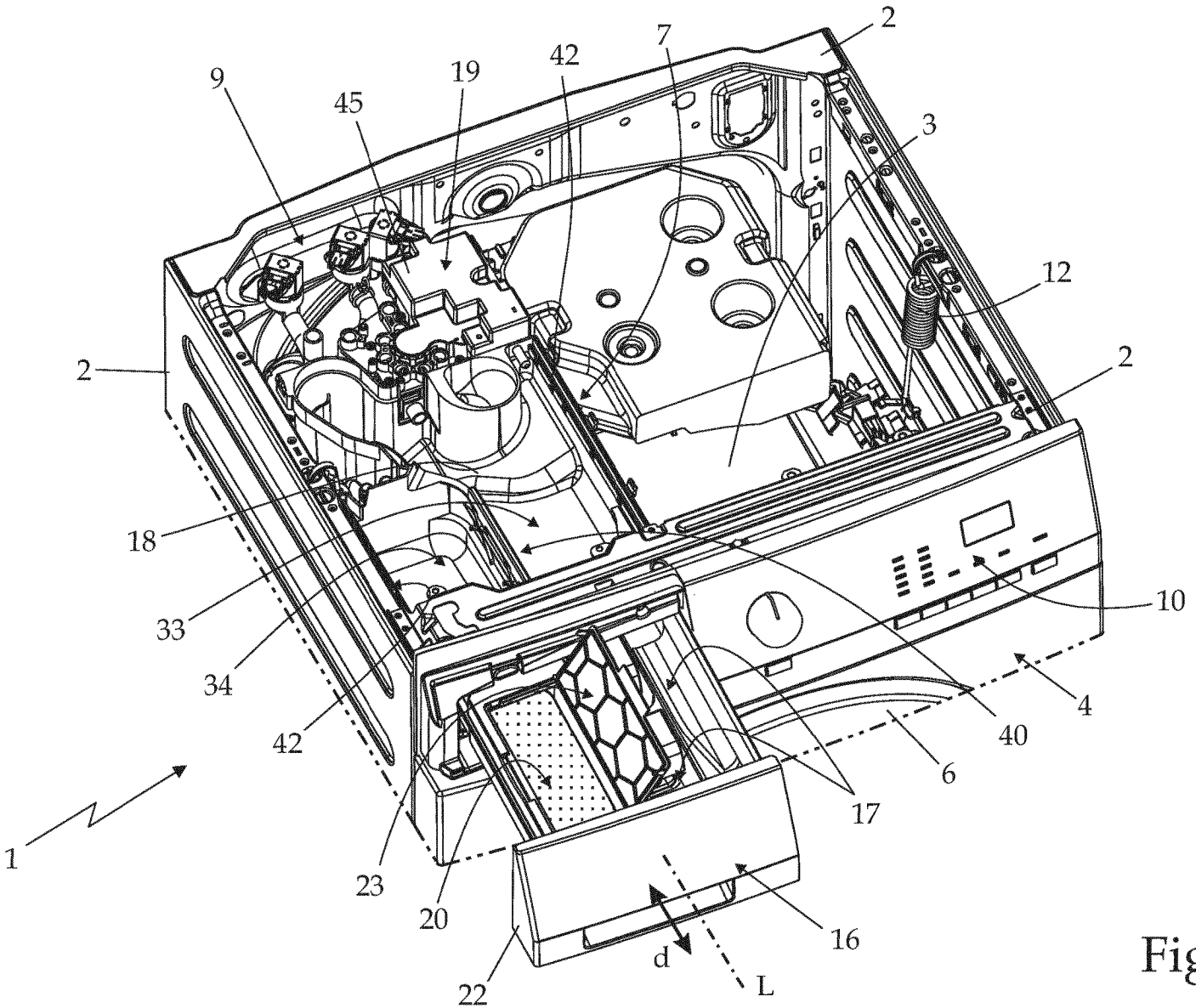
FIG. 3 is an enlarged perspective view of the top of the FIG. 1 laundry washing machine, with parts removed for clarity.

With reference to FIGS. 1, 2 and 3, the laundry washing machine 1 furthermore comprises: a detergent dispenser 7 which is located inside the casing 2 preferably above the washing tub 3 and preferably, though not necessarily, immediately underneath the upper worktop or top wall 8 of casing 2, and is structured for selectively feeding into the washing tub 3, according to the washing cycle manually-selected by the user, a given amount of detergent, softener and/or other washing agent suitably mixed with fresh-water; and a fresh-water supply circuit 9 which is connectable directly to the water mains, and is structured for selectively channelling, according to the washing cycle manually-selected by the user, a flow of fresh-water from the water mains to the detergent dispenser 7 or directly to the washing tub 3. Preferably the laundry washing machine 1 additionally comprises an appliance control panel 10 which is preferably located stationary on front wall 4 of casing 2, above the laundry loading/unloading opening and preferably also immediately beneath the upper worktop or top wall 8 of casing 2, and is structured to allow the user to manually select the desired washing cycle among a number of available washing cycles.

Figure 4:
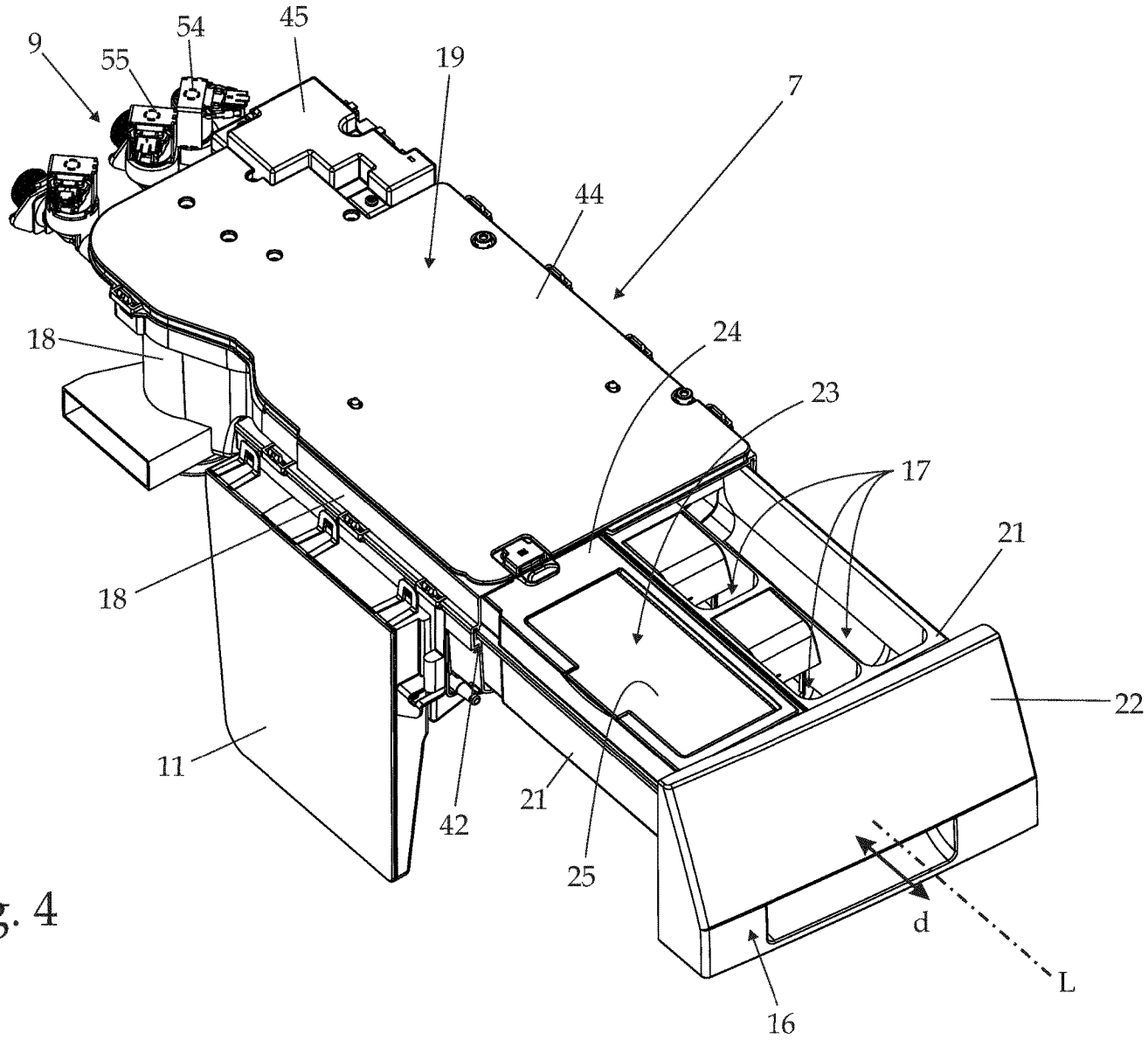
FIG. 4 is a perspective view of several inner component parts of the FIG. 1 laundry washing machine, assembled to one another.
Figure 5:
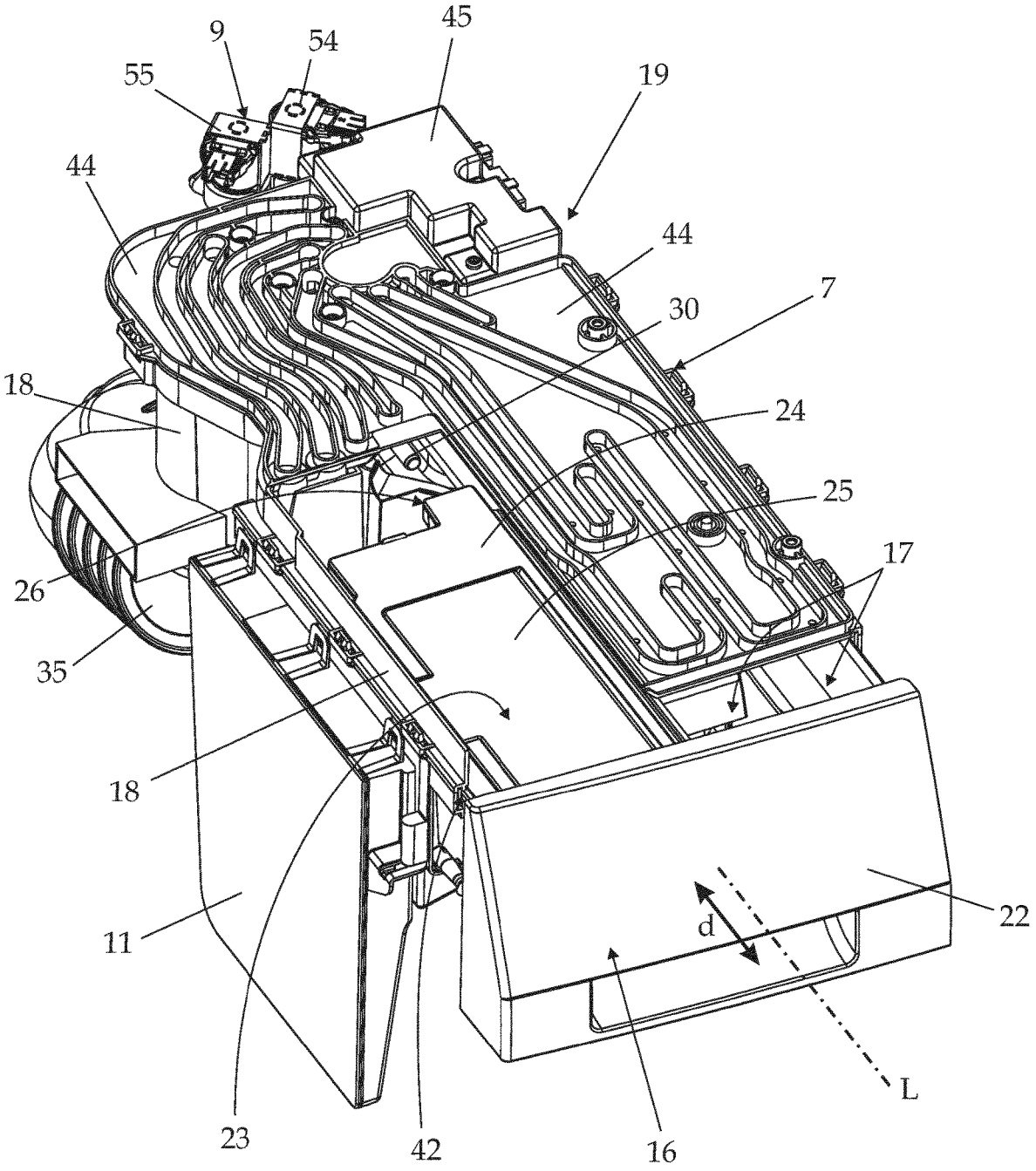
FIG. 5 is a perspective view of the FIG. 4 component-parts assembly, with parts removed for clarity

In addition to the above, with reference to FIGS. 2, 4 and 5, the laundry washing machine 1 furthermore comprises an internal water softening device 11 which is located inside the boxlike casing 2 along the fresh-water supply circuit 9 or the detergent dispenser 7, and is structured for selectively reducing, during each washing cycle, the hardness degree of the tap water that the fresh-water supply circuit 9 channels towards detergent dispenser 7 or washing tub 3.

More in detail, the water softening device 11 is preferably internally contains a given amount of ion-exchange resins capable of restraining the calcium and magnesium ions (Ca++ and Mg++) dissolved in the water that flows through the same water softening device 11, so as to reduce the hardness degree of the tap water directed towards the detergent dispenser 7 or the washing tub 3.

In the example shown, furthermore, the water softening device 11 is preferably located inside the boxlike casing 2 immediately adjacent to the detergent dispenser 7, and is preferably fluidically connected to the detergent dispenser 7 so as to be crossed by the fresh-water flowing towards the washing tub 3 via the detergent dispenser 7.

With reference to FIGS. 1 and 2, in the example shown, in particular, the rotatable drum (not shown) of laundry washing machine 1 is preferably arranged inside the washing tub 3 with the drum rotation axis locally substantially coaxial to the longitudinal axis of washing tub 3, i.e. oriented substantially horizontally, and with the circular front opening or mouth of the drum directly aligned and faced to the circular front opening or mouth of washing tub 3, so as to receive the laundry to be washed through the laundry loading/unloading opening realized on front wall 4.

The washing tub 3, in turn, is preferably suspended in floating manner inside the casing 2 via a suspension system that preferably, though not necessarily, comprises at least one, and preferably a couple of upper coil springs 12 connecting the upper portion of washing tub 3 to the top of casing 2, and preferably at least one, and preferably a couple of vibration dampers 13 connecting the bottom portion of washing tub 3 to the bottom of casing 2. Moreover the laundry washing machine 1 is preferably provided with a substantially cylindrical elastically-deformable bellows (not shown) which watertight connects the front mouth of washing tub 3 to the laundry loading/unloading opening realized on front wall 4 of casing 2.

With reference to FIGS. 1-15, detergent dispenser 7, in turn, basically comprises: a detergent drawer 16 which is provided with one or more substantially basin-shaped, detergent compartments 17 (three detergent compartments 17 in the example shown) each structured for being manually fillable with a given amount of detergent, softener or other washing agent, and which is fitted/inserted in manually extractable manner into a corresponding substantially basin-shaped, drawer housing 18 which, in turn, is located/recessed inside the casing 2 above washing tub 3, and whose entrance is preferably located on front wall 4 of casing 2, above the laundry loading/unloading opening realized on the same front wall 4; and preferably also a drawer flush circuit 19 which is connected to the fresh-water supply circuit 9, and is structured for selectively channelling/pouring, when detergent drawer 16 is completely fitted/inserted into drawer housing 18, the fresh-water of the water mains into any one of the detergent compartments 17 of detergent drawer 16 so as to selectively flush the detergent, softener or other washing agent out of the same detergent compartment 17 and down onto the bottom of drawer housing 18.

More in detail, the entrance of drawer housing 18 is preferably located on a first portion of front wall 4, whereas the appliance control panel 10 is located on a second portion of front wall 4 substantially horizontally aligned beside said first portion.

Detergent drawer 16, in turn, is preferably movable inside the drawer housing 18 parallel to the substantially horizontally-oriented, longitudinal axis L of drawer housing 18 between:

- a retracted position (see FIG. 2) in which detergent drawer 16 is completely fitted/inserted into drawer housing 18, so as to be almost completely recessed into the front wall 4 of casing 2; and
- a completely extracted position (see FIGS. 1 and 3) in which detergent drawer 16 partly juts out from the front wall 4 of casing 2, so as to expose the one or more detergent compartments 17 at once.

In other words, detergent drawer 16 is movable inside the drawer housing 18 in a substantially horizontally-oriented, displacement direction d which is locally substantially parallel to the longitudinal axis L of both drawer housing 18 and detergent drawer 16, between:

- a retracted position (see FIG. 2) in which detergent drawer 16 is almost completely recessed into the front wall 4 of casing 2 and the one or more detergent compartments 17 of detergent drawer 16 are inaccessible to the user; and
- a completely extracted position (see FIGS. 1 and 3) in which detergent drawer 16 partly juts out from the front wall 4 of casing 2, so that the one or more detergent compartments 17 of detergent drawer 16 are fully accessible to the user.

With reference to FIGS. 1, 2 and 3, in the example shown, in particular, the entrance of drawer housing 18 is preferably located on front wall 4 of casing 2, immediately underneath the upper worktop or top wall 8 of casing 2 and horizontally adjacent to the appliance control panel 10. Moreover the longitudinal axis L of both detergent drawer 16 and drawer housing 18 and, as a result, the displacement direction d of detergent drawer 16, are preferably locally substantially perpendicular to front wall 4 of casing 2.

Preferably each detergent compartment 17 is furthermore dimensioned to accommodate a given amount of detergent, softener or other washing agent sufficient for performing only a single washing cycle.

In addition to the above, detergent drawer 16 preferably has, inside each detergent compartment 17, a siphon-assembly which is suitably shaped/dimensioned to selectively channel the mixture of water and detergent, softener or other washing agent formed inside the detergent compartment 17 on the bottom of drawer housing 18. As an alternative to the siphon-assembly, detergent drawer 16 may have, on the bottom of the detergent compartment 17, a large pass-through opening which is suitably shaped/dimensioned to allow the mixture of water and detergent, softener or other washing agent formed inside the same detergent compartment 17 to freely fall by gravity on the bottom of drawer housing 18.

The drawer flush circuit 19, in turn, is preferably structured for directly pouring, when detergent drawer 16 is placed in the retracted position, a shower of water droplets selectively and alternatively into any one of the detergent compartments 17 of detergent drawer 16, so as to selectively flush the detergent, softener or other washing agent out of the same detergent compartment 17 and down onto the bottom of drawer housing 18.

Preferably, the internal water softening device 11 is furthermore connected to the drawer flush circuit 19 of detergent dispenser 7 so as to be crossed by the fresh water that is subsequently poured into the detergent compartment/s 17 of detergent drawer 16, so that the hardness degree of the fresh-water of the water mains poured into any one of the detergent compartments 17 of detergent drawer 16 is reduced.

With particular reference to FIGS. 3-5 and 10-15, detergent drawer 16 is furthemore provided with a substantially basin-shaped, regeneration-agent compartment 20 which is structured for being manually fillable with a given amount of consumable salt (NaCl) or other regeneration agent suitable to be used in the regeneration process of the ion-exchange resins of the water softening device 11, and which is located on detergent drawer 16 beside the detergent compartment/s 17, preferably so that detergent compartment/s 17 and regeneration-agent compartment 20 are allowed to almost contemporaneously come out from the front wall 4 of casing 2 when detergent drawer 16 moves from the retracted position to the extracted position.

Preferably the regeneration-agent compartment 20 is moreover dimensioned to accommodate an amount of consumable salt (NaCl) or other regeneration agent sufficient for performing a plurality of regeneration processes of the ion-exchange resins of the water softening device 11.

In the example shown, in particular, the regeneration-agent compartment 20 is preferably arranged on detergent drawer 16 beside the one or more detergent compartments 17 transversally to the displacement direction d of detergent drawer 16, i.e. transversally to the longitudinal axis L of detergent drawer 16, so that detergent compartment/s 17 and regeneration-agent compartment 20 are arranged on opposite sides of a substantially vertically-oriented, reference plane which is parallel to the displacement direction d of detergent drawer 16 inside drawer housing 18, i.e. parallel to the longitudinal axis L of detergent drawer 16.

Detergent drawer 16 is therefore movable inside drawer housing 18 in the substantially horizontally-oriented, displacement direction d between:

- a retracted position (see FIG. 2) in which detergent drawer 16 is completely recessed into the front wall 4 of casing 2, so that both the detergent compartment/s 17 and the regeneration-agent compartment 20 are inaccessible to the user; and
- a completely extracted position (see FIGS. 1 and 3) in which detergent drawer 16 partly juts out from the front wall 4 of casing 2, so that both the detergent compartment/s 17 and the regeneration-agent compartment 20 are simultaneously fully accessible to the user.

Figure 12:
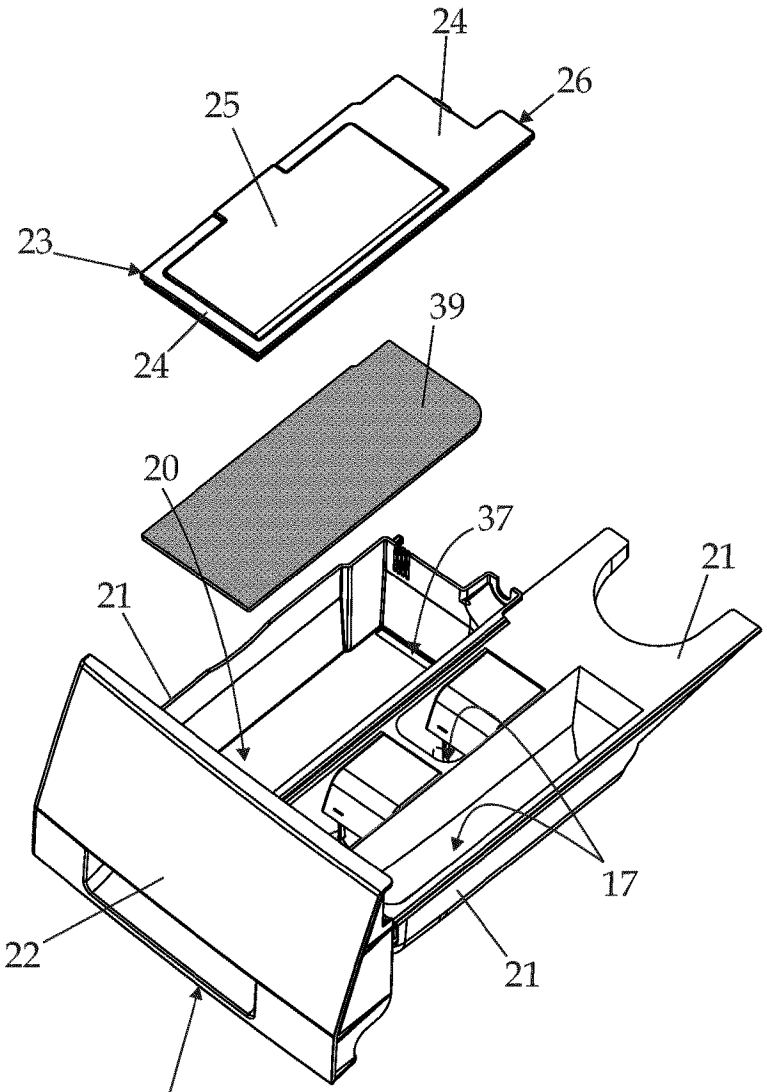
FIG. 12 is a partially exploded perspective view of the detergent drawer shown in FIGS. 10 and 11, with parts removed for clarity.
Figure 10:
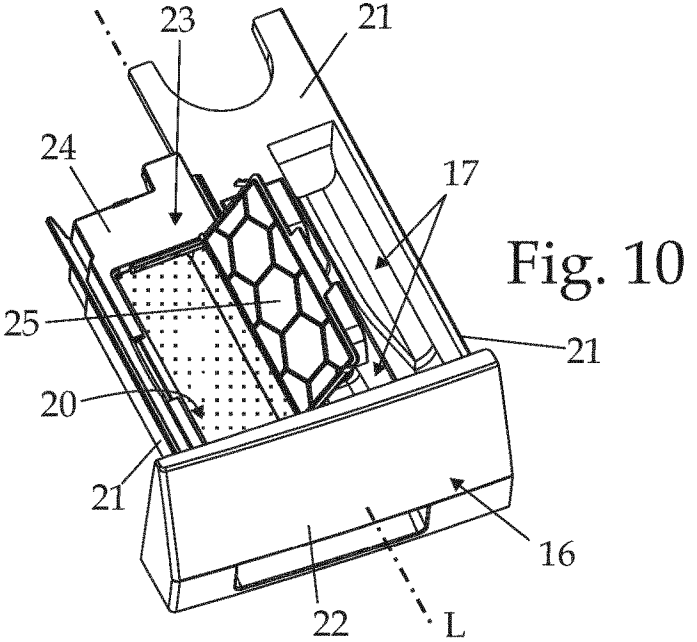
FIGS. 10 and 11 are two perspective views of the detergent drawer of the detergent dispenser shown in FIG. 6.
Figure 11:
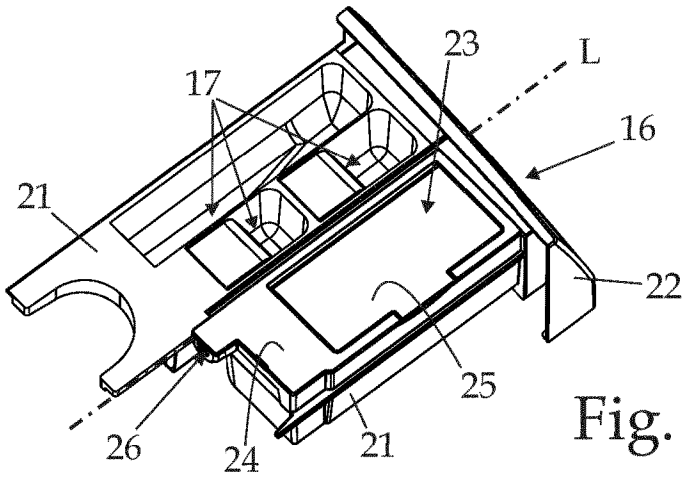

With reference to FIG. 12, preferably detergent drawer 16 furthermore has, on the bottom of the regeneration-agent compartment 20, a large pass-through opening 37 which is suitably shaped/dimensioned to allow the brine formed inside the regeneration-agent compartment 20 to freely fall by gravity on the bottom of drawer housing 18.

The drawer flush circuit 19 of detergent dispenser 7, in turn, is preferably additionally structured for also selectively pouring, when detergent drawer 16 is placed in the retracted position, a given amount of fresh-water of the water mains into the regeneration-agent compartment 20, so as to dissolve some of the salt grains contained into the regeneration-agent compartment 20 and form some brine that falls on the bottom of drawer housing 18.

In other words, drawer flush circuit 19 is directly connected to the fresh-water supply circuit 9 for receiving the fresh-water of the water mains, and is suitably structured for selectively pouring, when the detergent drawer 16 is completely fitted/inserted into drawer housing 18, the fresh-water arriving from the water mains into any one of the detergent or regeneration-agent compartments 17, 20 of detergent drawer 16.

In case of detergent compartment/s 17, the poured fresh-water serves to selectively flush the contents of the detergent compartment 17 out of the same compartment 19 and down on the bottom of drawer housing 18. In case of regeneration-agent compartment 20, the poured fresh-water serves to dissolve some salt contained into the regeneration-agent compartment 20 to form some brine that falls on the bottom of drawer housing 18.

Figure 6:
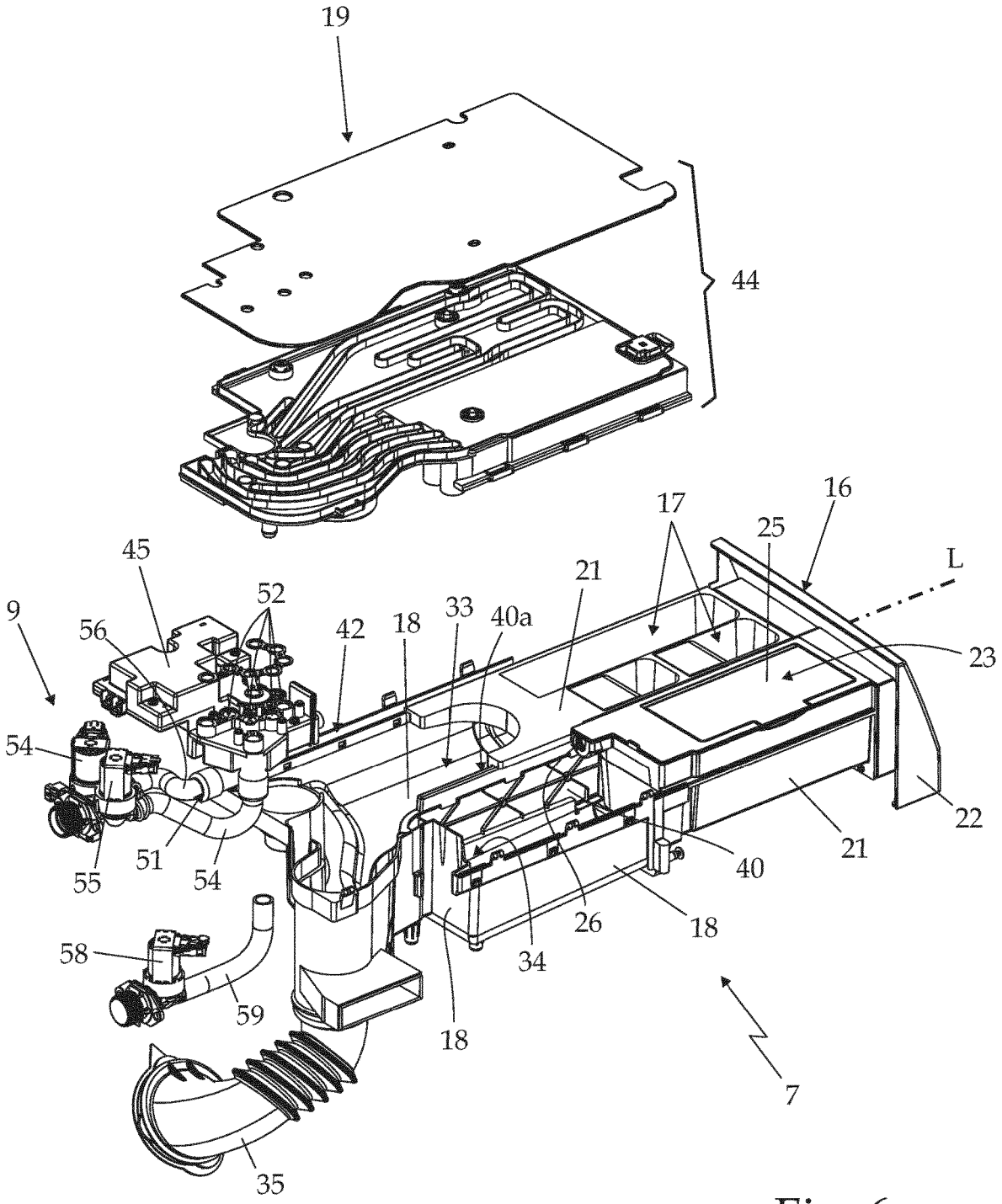
FIG. 6 is a partially exploded perspective view of the FIG. 4 component-parts assembly, with parts removed for clarity.
Figure 8:
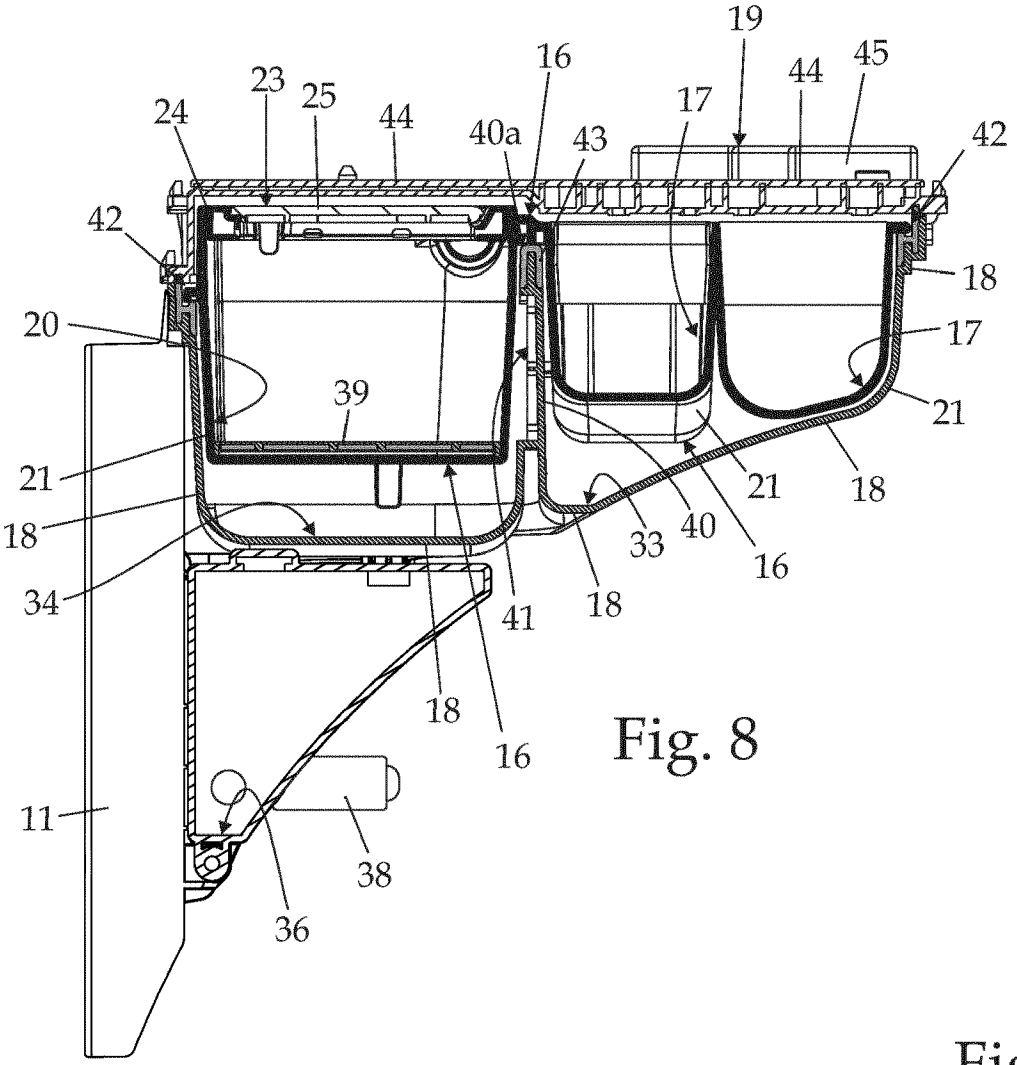
FIG. 8 is a sectioned front view of the detergent drawer and the drawer housing of the detergent dispenser shown in FIGS. 4 and 5, with parts removed for clarity.

With reference to FIGS. 3, 6 and 8, the bottom of drawer housing 18, in turn, is preferably divided into two substantially basin-shaped bottom portions which are vertically aligned, when detergent drawer 16 is placed in the retracted position, respectively to all detergent compartments 17, and to the regeneration-agent compartment 20.

Preferably, the internal water softening device 11 is furthermore connected to the drawer flush circuit 19 of detergent dispenser 7 so as to be crossed by the fresh water that is subsequently poured into the detergent compartment/s 17 of detergent drawer 16 and optionally into the regeneration-agent compartment 20, so that the hardness degree of the fresh-water of the water mains poured into any one of the detergent or regeneration-agent compartments 19, 20 of detergent drawer 16 is significantly reduced.

More in detail, with particular reference to FIGS. 4-6 and 10-15, detergent drawer 16 comprises: a single drawer-like supporting structure 21 which is preferably made in a one piece construction, and is fitted/inserted in axially sliding manner into the drawer housing 18; and a manually-sizable front panel 22 which is arranged/located on a front side of the drawer-like supporting structure 21, so as to close the entrance of the drawer housing 18 when detergent drawer 16 is placed in the retracted position (see FIG. 2).

In other words, the manually-sizable front panel 22 is arranged/located on the front side of the drawer-like supporting structure 21, so as to be arranged locally substantially coplanar to the front face 4 of casing 2, beside the appliance control panel 10, when detergent drawer 16 is placed in the retracted position (see FIG. 2).

With reference to FIGS. 3-12, the detergent compartment/s 17 and the regeneration-agent compartment 20 are therefore directly formed on the drawer-like supporting structure 21, and are preferably arranged on the drawer-like supporting structure 21 transversally to the displacement direction d of detergent drawer 16, i.e. transversally to the longitudinal axis L of detergent drawer 16.

In the example shown, in particular, the drawer-like supporting structure 21 of detergent drawer 16 is preferably made in a single piece, via an injection moulding process. Preferably the same applies to the manually-sizable front panel 22.

Moreover, with reference to FIGS. 1-15, detergent drawer 16 additionally comprises a manually openable, upper lid assembly 23 which is firmly fitted on the drawer-like supporting structure 21, on top of the regeneration-agent compartment 20, so as to move together with the drawer-like supporting structure 21, and is structured to selectively close the upper mouth of regeneration-agent compartment 20, preferably so as to almost completely cover the same upper mouth of regeneration-agent compartment 20.

Preferably the upper lid assembly 23 is moreover structured so as to be able to receive, at least when detergent drawer 16 is placed in the retracted position, a flow of fresh-water from drawer flush circuit 19 and channel said fresh-water into the beneath-located regeneration-agent compartment 20, preferably while spreading out the same fresh-water inside the regeneration-agent compartment 20.

In other words, the upper lid assembly 23 is preferably provided with a water inlet which is faced to the outside of regeneration-agent compartment 20 and is structured to allow the fresh-water to enter into the same upper lid assembly 23, and with one or more water outlets which are faced to the inside of regeneration-agent compartment 20, fluidically communicate with the water inlet and are finally suitably structured to allow the water entering into the upper lid assembly 23 through the water inlet to come out of the lid assembly 23 and fall into the regeneration-agent compartment 20.

More in detail, the water inlet of the upper lid assembly 23 is structured for receiving, when detergent drawer 16 is placed in the retracted position, a flow of fresh-water from the drawer flush circuit 19, whereas the upper lid assembly 23 is structured for channelling said fresh-water into the beneath-located regeneration-agent compartment 20, preferably while spreading out the same fresh-water inside the regeneration-agent compartment 20.

In other words, drawer flush circuit 19 is preferably structured to selectively channel, when detergent drawer 16 is placed in the retracted position, the fresh-water of the water mains into the water inlet of the upper lid assembly 23 which, in turn, is structured to distribute the fresh-water arriving from the drawer flush circuit 19 into the regeneration-agent compartment 20.

In addition to the above, in the example shown the water inlet of the upper lid assembly 23 is preferably furthermore structured to couple, when the detergent drawer 16 is placed in the retracted position, in a stable, though easy detachable manner, with the drawer flush circuit 19 for receiving the fresh-water of the water mains directly from the drawer flush circuit 19, and to sprinkle said fresh-water into the regeneration-agent compartment 20.

With reference to FIGS. 10-14, in the example shown, in particular, the upper lid assembly 23 preferably comprises a frame member 24 which is structured to rigidly fit into the upper rim of regeneration-agent compartment 20; and a manually-movable trapdoor 25 which is movably coupled to frame member 24 so as to selectively close a preferably substantially rectangular-shaped, large pass-through opening which is delimited by the frame member 24 and is suitably shaped/dimensioned to allow the user to easily manually pour the consumable salt (NaCl) or other regeneration agent into the regeneration-agent compartment 20.

The frame member 24 is preferably provided with a water inlet 26 which is faced to the outside of regeneration-agent compartment 20, and is suitably structured for receiving the fresh-water from the drawer flush circuit 19 when detergent drawer 16 is placed in the retracted position; and with one or more water-delivery portions 27 which are arranged on the lower face of frame member 24, preferably all around the central pass-through opening closed by trapdoor 25, so as to be faced to the inside of regeneration-agent compartment 20. Each of these water-delivery portions 27 fluidically communicates with the water inlet 26, and is suitably structured to allow the outflow of the fresh-water from the frame member 24.

Preferably the water-delivery portions 27 are furthermore suitably shaped/structured so as to pour a shower of water droplets by gravity into the regeneration-agent compartment 20.

Figure 9:
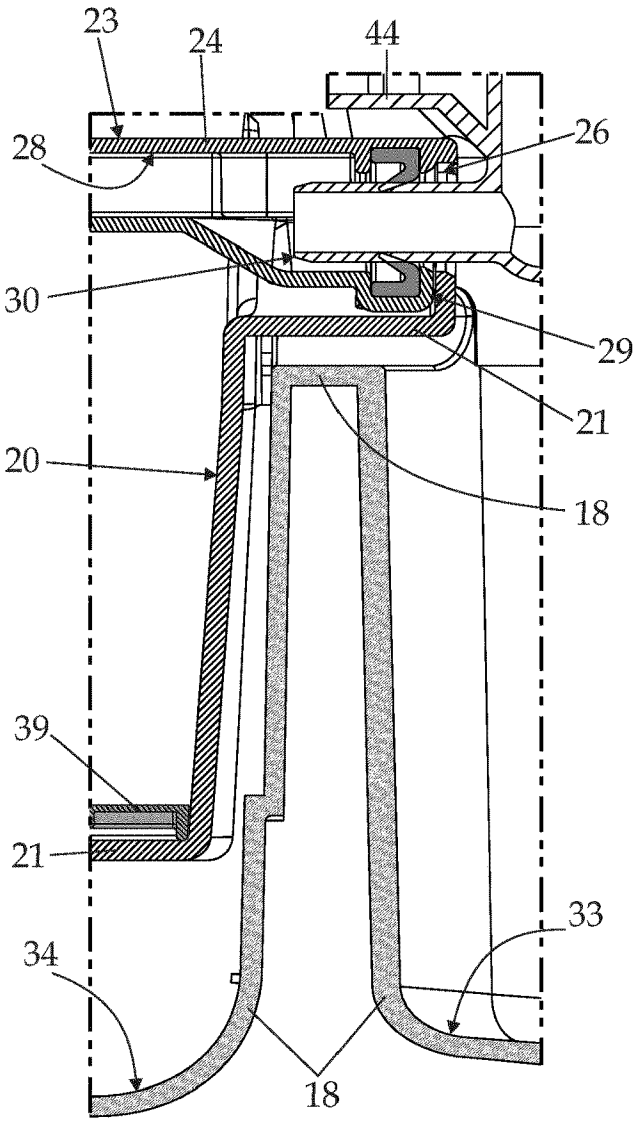
FIG. 9 is a sectioned side view of a portion of the FIG. 4 component-parts assembly, with parts removed for clarity.
Figure 14:
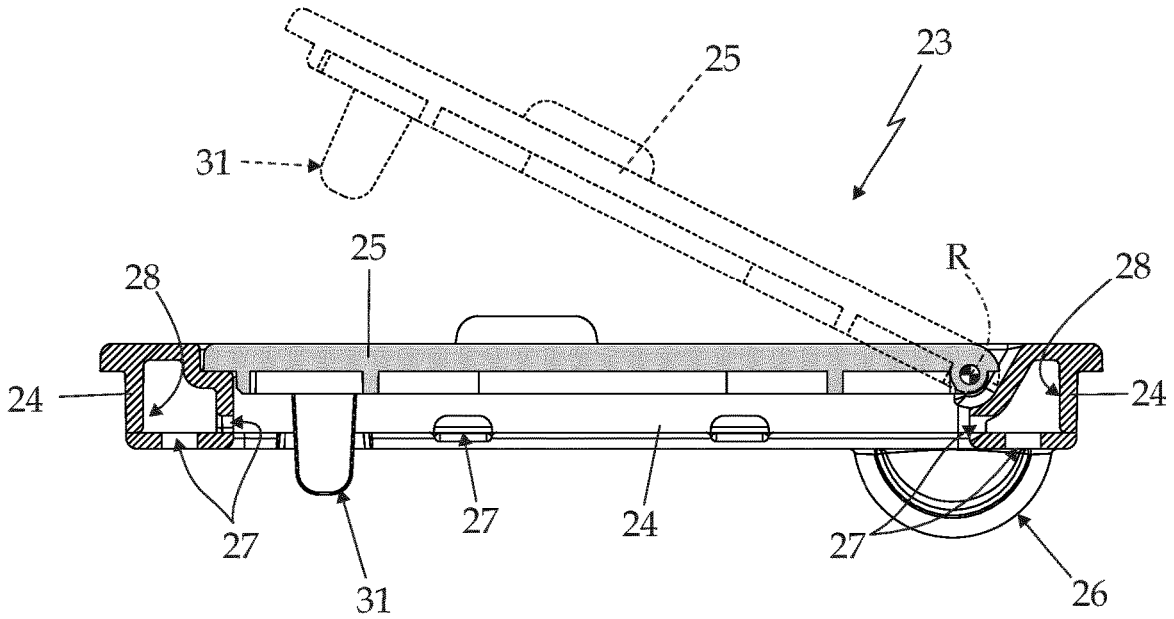
FIG. 14 is a sectioned front view of the FIG. 13 upper lid with parts removed for clarity.

More in detail, with reference to FIGS. 8, 9, 14 e 15, in the example shown frame member 24 is preferably provided with one or more internal water channels 28 each of which begins at water inlet 26 and extends inside the body of frame member 24 up to reach a number of water-delivery portions 27 which, in turn, are suitably structured to allow the water flowing inside the internal water channel/s 28 to slowly come out of frame member 24 and drip into the regeneration-agent compartment 20.

Figure 7:
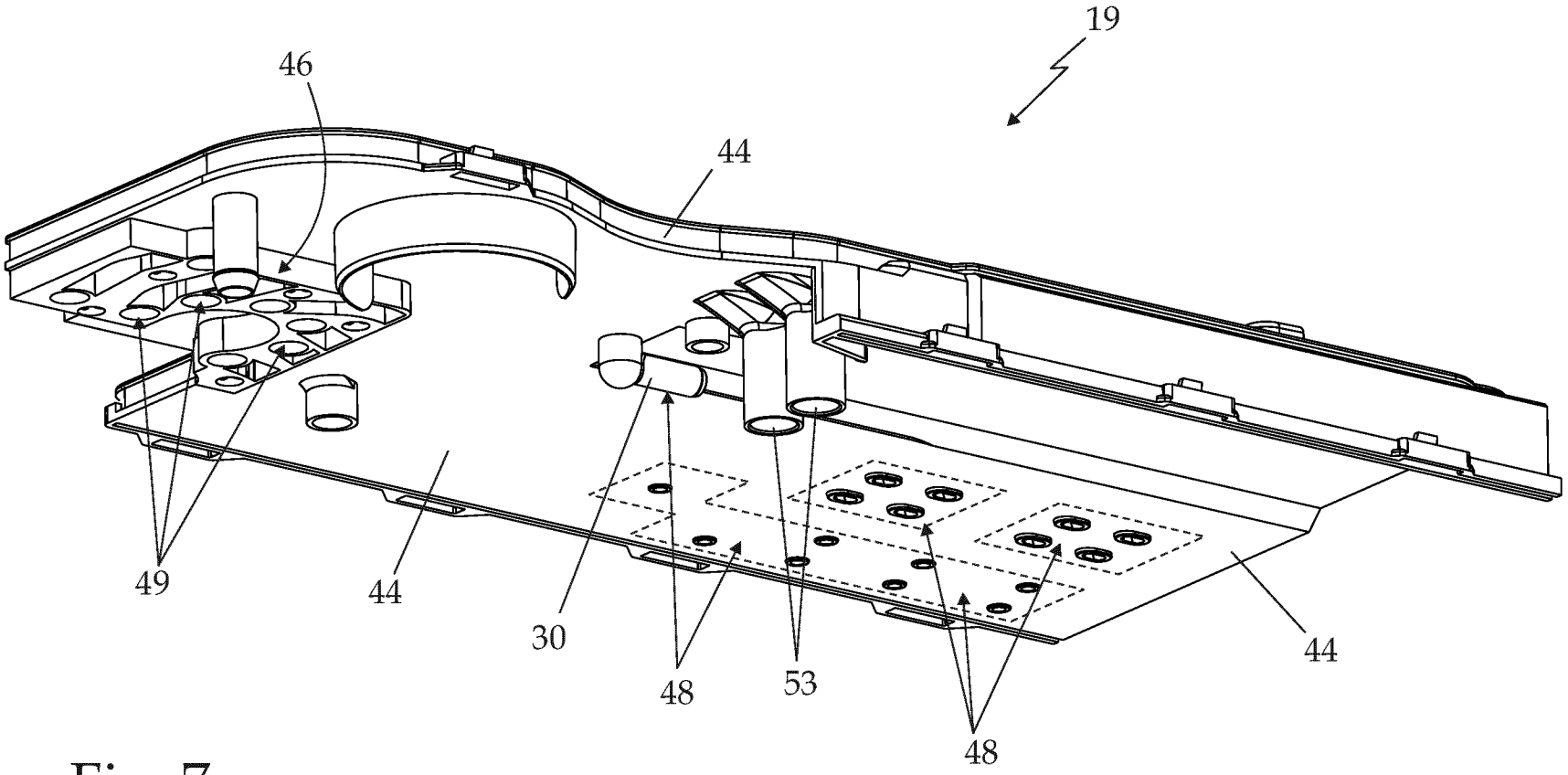
FIG. 7 is a perspective view of the upper lid of the drawer housing of the detergent dispenser shown in FIG. 6.
Figure 15:
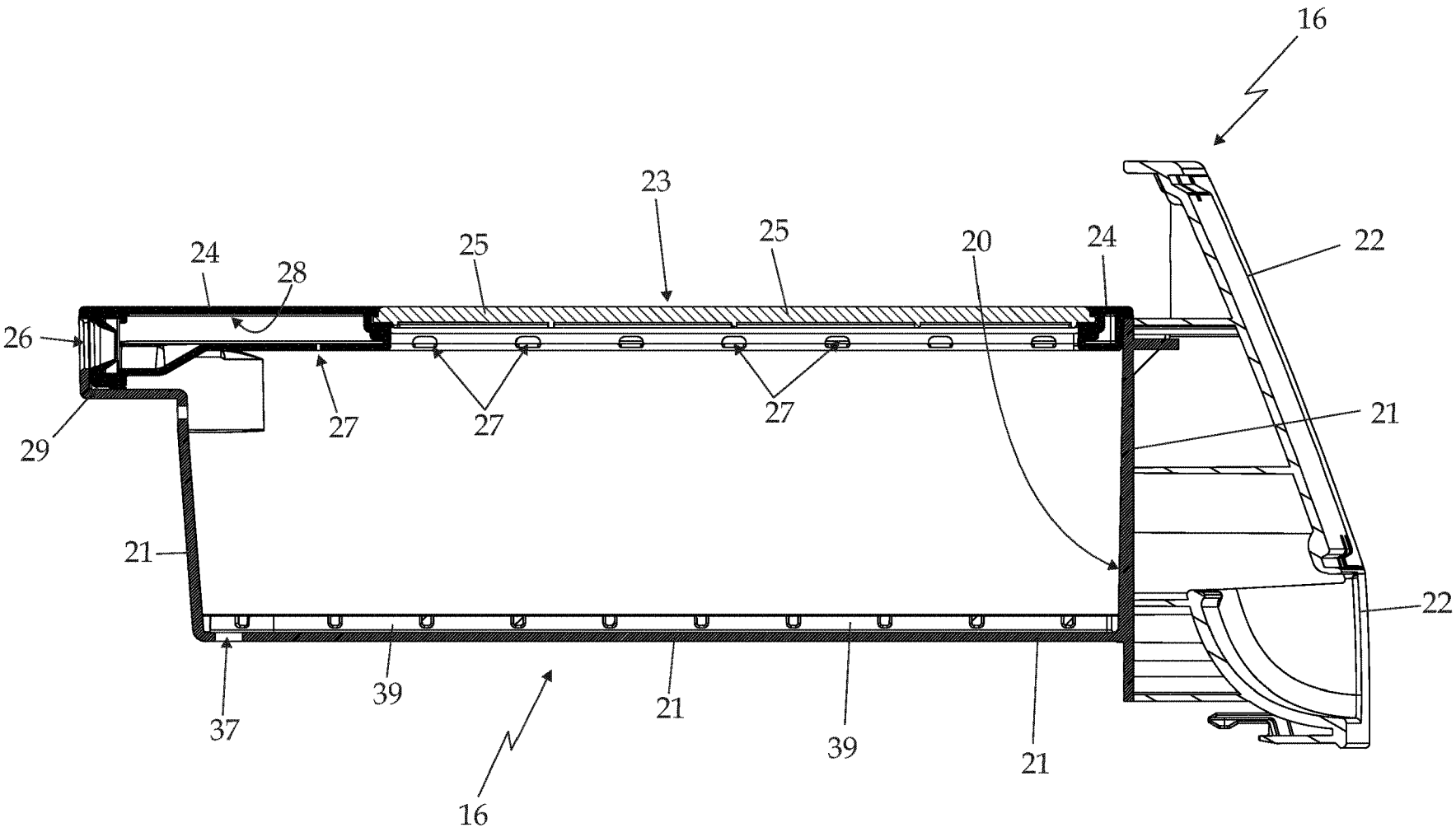

With particular reference to FIGS. 7, 9 and 15, in the examples shown, in particular, the water inlet 26 of frame member 24 preferably comprises a first hydraulic connector 29 which is integral to frame member 24 and protrudes from the back of detergent drawer 16 substantially parallel to the displacement direction d of detergent drawer 16.

Hydraulic connector 29 is structured to substantially watertight couple in a stable, though easy detachable manner, with a complementary second hydraulic connector 30 which is located stationary inside the drawer housing 18, so as to couple with hydraulic connector 29 when detergent drawer 16 is placed in the retracted position, and to uncouple from the complementary second hydraulic connector 30 when detergent drawer 16 is moves in the extracted position.

Second hydraulic connector 30, in turn, preferably communicates with the drawer flush circuit 19 for receiving the fresh-water directed to the regeneration-agent compartment 20.

With particular reference to FIGS. 3 and 10-15, the trapdoor 25, in turn, is preferably laterally hinged to the frame member 24 so as to be able to freely rotate about a reference axis R preferably locally substantially parallel to the longitudinal axis L of detergent drawer 16, i.e. parallel to the displacement direction d of detergent drawer 16, to and from a closed position (see FIG. 14) in which the trapdoor 25 is arranged substantially coplanar to the frame member 24 and closes the central pass-through opening of the frame member 24.

More in detail, trapdoor 25 is preferably rotatable about reference axis R between a closed position (see FIG. 14) in which trapdoor 25 is arranged substantially coplanar to the frame member 24 thus to close the central pass-through opening of frame member 24, and an opened position in which the trapdoor 25 is moved sideways of the central pass-through opening of frame member 24, preferably roughly above the one or more detergent compartments 17 of detergent drawer 16, thus to partially cover some of the detergent compartments 17.

Obviously, in an alternative embodiment the trapdoor 25 could be laterally hinged to the frame member 24 so as to be able to rotate about a reference axis R locally substantially perpendicular to the longitudinal axis L of detergent drawer 16, i.e. perpendicular to the displacement direction d of detergent drawer 16.

Figure 13:
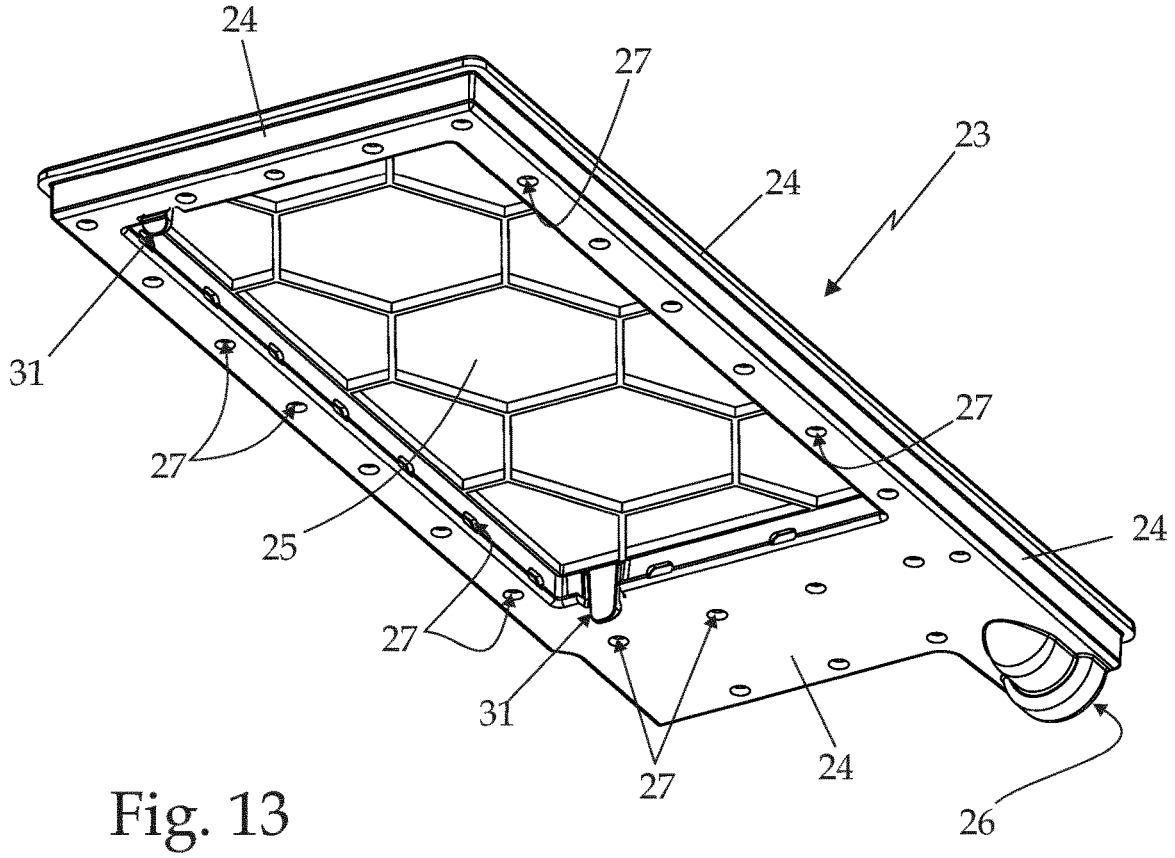
FIG. 13 is a perspective view of the upper lid of the salt compartment of the FIG. 12 detergent drawer.

With reference to FIGS. 13 and 14, the upper lid assembly 23 is preferably finally provided with one or more snap-on locking portions 31 which are incorporated in the trapdoor 25 and/or in the frame member 24, and are suitably structured to firmly lock the trapdoor 25 to the frame member 24 in a stable, tough easy releasable manner, when the trapdoor 25 is arranged in the closing position.

As regards the drawer housing 18, with reference to FIGS. 1, 2 and 3, the entrance of drawer housing 18 is located on front wall 4 of casing 2, preferably immediately underneath the upper worktop or top wall 8 of casing 2 and substantially horizontally aligned beside the appliance control panel 10.

With reference to FIGS. 3, 5, 6 and 8, furthermore the bottom of drawer housing 18 is preferably provided with two separated and substantially basin-shaped bottom portions 33 and 34, which are arranged side by side to one another transversally to the displacement direction d of detergent drawer 16 inside drawer housing 18, i.e. transversally to the longitudinal axis L of drawer housing 18, so as to be vertically aligned, when detergent drawer 16 is placed in the retracted position, one underneath the one or more detergent compartments 17, and the other underneath the regeneration-agent compartment 20.

The basin-shaped bottom portion 33 vertically aligned to the detergent compartment/s 17 is structured to collect the mixture of water and detergent, softener or other washing agent coming out from any one of the detergent compartments 17 of detergent drawer 16 preferably through the corresponding siphon assembly, and preferably communicates with the inside of washing tub 3 via a delivery duct 35 which branches off from the basin-shaped bottom portion 33 of drawer housing 18 and ends directly into the beneath-located washing tub 3, so as to allow the mixture of water and detergent, softener or other washing agent to flow by gravity directly into washing tub 3.

The basin-shaped bottom portion 34 vertically aligned to the regeneration-agent drawer 20, in turn, is structured to collect the brine falling down from the regeneration-agent compartment 20 preferably through the pass-through opening 37, and preferably directly communicates, via a substantially vertical and downwards-protruding pipe-extension, with the inside of a small brine container 36 which is firmly attached to the bottom of drawer housing 18, underneath the basin-shaped bottom portion 34. The brine arriving onto the basin-shaped bottom portion 34 of drawer housing 18 is therefore allowed to fall by gravity directly into the brine container 36 through the vertical pipe-extension.

Preferably the brine container 36, in turn, is in fluid communication with the inside of water softening device 11 via a small electric pump 38 which is structured to selectively pump the brine (i.e. the mixture of water and salt) from brine container 36 to the water softening device 11. In the example shown, in particular, electric pump 28 is preferably an electrically-powered volumetric pump.

In an alternative embodiment, however, the suction of volumetric pump 38 could be connected directly to a drain sump formed on the basin-shaped bottom portion 34 of drawer housing 18, whereas the delivery of volumetric pump 38 could be connected to the water softening device 11.

Moreover in a less sophisticated embodiment, the brine could freely flow by gravity into the water softening device 11 through a connecting duct that branches off from the basin-shaped bottom portion 34 of drawer housing 18 and ends directly into the water softening device 11. In this case, preferably an automatic one-way valve or an electrically-operated on-off valve could be arranged along said connecting duct to control the outflow of the brine towards the water softening device 11.

With reference to FIGS. 8, 9, 12 and 15, preferably the detergent drawer 16 furthermore comprises a preferably manually-removable, horizontal partitioning septum 39 which extends inside the regeneration-agent compartment 20 above to the bottom of regeneration-agent compartment 20 and its large pass-through opening 37, and has a water-permeable structure designed for preventing the grains of consumable salt to come out of the regeneration-agent compartment 20 via the pass-through opening 37 and, at same time, for allowing the brine to trickle onto the bottom of the regeneration-agent compartment 20 and then freely flow by gravity towards the pass-through opening 37.

Preferably the partitioning septum 39 furthermore has a water-permeable structure suitably designed to slow down the outflow of the brine from the regeneration-agent compartment 20 via pass-through opening 37 for causing a temporarily stagnation of the water poured into the regeneration-agent compartment 20, above the same partitioning septum 39.

In other words, the water-permeable partitioning septum 39 is arranged above the pass-through opening 37 so as to completely cover the latter, and is preferably structured to allow the passage of the water/brine through the same partitioning septum 39 with a flowrate which is lower than that of the fresh-water poured into the regeneration-agent compartment 20 by drawer flush circuit 19, thus to cause the stagnation of the fresh-water above the partitioning septum 39.

Preferably the water-permeable partitioning septum 39 furthermore extends inside regeneration-agent compartment 20 slightly spaced from, and preferably also locally substantially parallel to, the bottom of regeneration-agent compartment 20, so as to form a thin air gap immediately above the bottom of regeneration-agent compartment 20.

In the example shown, in particular, the water-permeable partitioning septum 39 preferably consists in a rigid panel 32 preferably made of plastic material, which substantially copies the shape of the bottom of regeneration-agent compartment 20, and has a microperforated structure which is suitably dimensioned to cause a prolonged stagnation of the water poured into the regeneration-agent compartment 20 above the partitioning septum 39.

More in detail, the central portion of panel 32 is preferably provided with a plenty of substantially evenly distributed, transversal pass-through microholes or microslots each preferably having a cross-sectional area lower that 3 $mm^2$ (square millimetres), so as to allow the flow/passage of the brine/water through the partitioning septum 39 with a flowrate preferably ranging between between 0, 4 and 1 litre/min (litre per minute). The flowrate of the fresh-water poured into the regeneration-agent compartment 20 instead preferably ranges between 5 and 8 litre/min (litre per minute).

In addition to the above, with reference to FIG. 9, preferably the water inlet 26 of frame member 24, i.e. the hydraulic connector 29, is furthermore structured to protrude from the back of detergent drawer 16 substantially parallel to the displacement direction d of detergent drawer 16, so as to cantilevered extend, when detergent drawer 16 is placed in the retracted position, above the adjacent basin-shaped bottom portion 33 of drawer housing 18.

In other words, the water inlet 26 of upper lid assembly 23 is preferably structured to cantilevered protrude from detergent drawer 16 so as to be vertically aligned, when detergent drawer 16 is placed in the retracted position, above to the basin-shaped bottom portion 33 of drawer housing 18.

With reference to FIGS. 3, 6 and 7, the drawer housing 18 furthermore comprises a substantially vertical, partitioning wall 40 that protrudes upwards from the bottom of drawer housing 18 while remaining locally substantially parallel to the displacement direction d of detergent drawer 16, i.e. parallel to the longitudinal axis L of drawer housing 18, and the substantially basin-shaped bottom portions 33 and 34 are arranged on opposite sides of partitioning wall 40.

In other words the vertical partitioning wall 40 is arranged between the two substantially basin-shaped bottom portions 33 and 34 of drawer housing 18.

The detergent drawer 16, in turn, is arranged astride the partitioning wall 40 so that the one or more detergent compartments 17 and the regeneration-agent compartment 20 are arranged on opposite sides of partitioning wall 40.

More in detail, with reference to FIGS. 6 and 7, the bottom portion of the drawer-like supporting structure 21 of detergent drawer 16 is preferably provided with a rectilinear groove 41 which extends parallel to the longitudinal axis L of detergent drawer 16, i.e. parallel to the displacement direction d of detergent drawer 16 inside drawer housing 18, between the one or more detergent compartments 17 and the regeneration-agent compartment 20, and the partitioning wall 40 of drawer housing 18 protrudes from the bottom of drawer housing 18 and extends upwards into the rectilinear groove 41.

Preferably the drawer-like supporting structure 21 of detergent drawer 16 is furthermore coupled in sliding manner to partitioning wall 40.

More in detail, the drawer-like supporting structure 21 of detergent drawer 16 is preferably structured so to abut in axially sliding manner on the straight upper crest line 40*a* of partitioning wall 40, so that the detergent drawer 16 rests in abutment also onto the same partitioning wall 40.

With reference to FIGS. 3 and 7, in the example shown, in particular, the drawer-like supporting structure 21 of detergent drawer 16 is preferably laterally engaged/coupled in axially sliding manner to drawer housing 18 via two rectilinear runners or groves 42 that extend on the two reciprocally-faced sidewalls of drawer housing 18 locally substantially parallel to the displacement direction d of detergent drawer 16, i.e. parallel to the longitudinal axis L of detergent drawer 16 and drawer housing 18. Furthermore the drawer-like supporting structure 21 of detergent drawer 16 is preferably additionally centrally coupled in axially sliding manner to drawer housing 18 at the upper crest line 40*a* of partitioning wall 40.

Preferably, in the example shown, the upper crest line 40*a* of partitioning wall 40 is furthermore covered by a longitudinal element or rail 43 which is made of a material having a low friction coefficient and/or self-lubricating properties, such as Teflon or similar polymeric materials.

Preferably furthermore, in the example shown, the two rectilinear runners or groves 42 and the upper crest line 40*a* of partitioning wall 40 are preferably tilted upwards to the horizontal by an angle $\alpha$ lower that 5°.

With reference to FIG. 4-9, the drawer flush circuit 19 of detergent dispenser 7, in turn, preferably comprises:

a plate-like water delivery member 44 which is suitably structured to form the upper lid of the substantially basin-shaped drawer housing 18, so as to be located immediately above the detergent compartment/s 17 and the regeneration-agent compartment 20 when detergent drawer 16 is placed in the retracted position, i.e. when detergent drawer 16 is completely inserted/recessed into drawer housing 18, and is provided with a number of water-delivery portions each suitably structured to allow the outflow of water from the plate-like water delivery member 44 towards a respective compartment 19, 20 of detergent drawer 16; and an electrically-operated, flow-diverter 45 which is connected to the water softening device 11 and/or to the fresh-water supply circuit 9 for receiving the softened or unsoftened fresh-water, and is suitably structured to selectively channel the softened fresh-water arriving from the water softening device 11 or the unsoftened fresh-water arriving from the fresh-water supply circuit 9, towards any one of the water-delivery portions of the plate-like water delivery member 44.

More in detail, in the example shown the drawer flush circuit 19 of detergent dispenser 7 preferably comprises: a plate-like water delivery member 44 which is suitably structured to form the upper lid of the substantially basin-shaped drawer housing 18 of detergent dispenser 7, so as to be located immediately above the detergent drawer 16 when the latter is placed in the retracted position, i.e. when it is completely inserted/recessed into drawer housing 18; and a discrete, electrically-operated, flow-diverter module 45 which is connected to the water softening device 11 and or to the fresh-water supply circuit 9, and is fixed/attached outside of the plate-like water delivery member 44, at a coupling socket 46 preferably realized on one of the two major faces of the plate-like water delivery member 44.

With particular reference to FIG. 7, the plate-like water delivery member 44 is provided, on the side directly faced to the inside of drawer housing 18, with a number of water-delivery portions 48 each of which is suitably structured to allow the outflow of the water from the plate-like water delivery member 44, and with a number of water inlets 49 each of which is located at coupling socket 46 and separately communicates with a respective water-delivery portion 48 of the plate-like water delivery member 44.

Some water-delivery portions 48 are preferably arranged on the plate-like water delivery member 44 so as to be locally substantially vertically aligned, when detergent drawer 16 is placed in the retracted position, each to a respective detergent compartment 17 of detergent drawer 16, and are suitably structured to allow the outflow of the fresh-water from the plate-like water delivery member 44 towards the beneath-located detergent compartment 17.

Preferably a further water-delivery portion 48 is arranged on the plate-like water delivery member 44 so as to be locally substantially vertically aligned, when detergent drawer 16 is placed in the retracted position, to the regeneration-agent compartment 20 of detergent drawer 16, and is suitably structured to channel the softened or unsoftened fresh-water of the water mains towards the upper lid assembly 23 of detergent drawer 16.

More in detail, this further water-delivery portion 48 is preferably suitably structured to channel, when detergent drawer 16 is placed in the retracted position, the softened or unsoftened fresh-water towards the water inlet 26 of frame member 24.

In the example shown, in particular, the water-delivery portions 48 of plate-like water delivery member 44 vertically aligned to the detergent compartment/s 17 are preferably structured to pour by gravity a shower of water droplets directly into the beneath-located detergent compartment 17 of detergent drawer 16.

The further water-delivery portion 48, in turn, preferably ends with the hydraulic connector 30 structured to couple with the hydraulic connector 29 of frame member 24 when detergent drawer 16 is completely fitted/inserted into drawer housing 18, i.e. when detergent drawer 16 is placed in the retracted position.

With reference to FIG. 6, in turn the electrically-operated flow-diverter preferably has a main water inlet 51 which communicates with the water softening device 11 for receiving softened fresh-water, and preferably also directly with the fresh-water supply circuit 9 for also receiving unsoftened fresh-water; and a number of main water outlets 52 which are faced to the coupling socket 46 of plate-like water delivery member 44, and are structured to separately communicate each with a respective water inlet 49 of plate-like water delivery member 44. Furthermore the flow-diverter module 45 is internally structured to selectively channel, towards any one of its water outlets 52, the fresh-water entering into the flow-diverter module 45 via the main water inlet 51, so as to be able to selectively channel a flow of softened or unsoftened fresh-water into any one of the water inlets 49 of the plate-like water delivery member 44.

More in detail, with reference to FIGS. 4, 5, 6, 7 and 8, in the example shown the plate-like water delivery member 44 is preferably provided with a number of internal water channels each of which separately begins at coupling socket 46, and extends inside the body of plate-like water delivery member 44 up to reach a corresponding water-delivery portion 48 of plate-like water delivery member 44. Each water outlet 52 of flow-diverter module 45, in turn, is substantially watertight coupled, at coupling socket 46, with the mouth of a corresponding internal water channel of the plate-like water delivery member 44.

Preferably, moreover, the flow-diverter module 45 internally accommodates a rotatable flow diverter (not shown) which is capable of channelling, according to its angular position, the water entering into the flow-diverter module 45 via the water inlet 51 towards any one of the water outlets 52 of the flow-diverter module 45.

In addition to the above, the flow-diverter module 45 preferably furthermore comprises an electrically-operated motor assembly (not shown) which is mechanically connected to the rotatable flow diverter for controlling the angular position of the flow diverter, and optionally also an electronic control unit which is structured to directly power and control the electrically-operated motor assembly according to electric signals arriving from the main electronic central control unit (not shown) of the laundry washing machine 1.

With reference to FIGS. 4, 5 and 7, the internal water softening device 11, in turn, is preferably hydraulically connected directly to the plate-like water delivery member 44 of drawer flush circuit 19, so as to be crossed by the fresh-water that is subsequently poured into any one of the detergent compartments 17 and optionally also into the regeneration-agent compartment 20 of detergent drawer 16, so that the hardness degree of the fresh-water of the water mains poured into any one of the detergent compartments 17 of detergent drawer 16 or optionally into the regeneration-agent compartment 20 is reduced.

More in detail, in the example shown the water softening device 11 is preferably rigidly attached to the drawer casing 7, and the water inlet and water outlet of the same water softening device 11 are preferably hydraulically connected directly to the plate-like water delivery member 44 preferably by means of two hydraulic connectors 53 that protrude from the lower face of the plate-like water delivery member 44, i.e. from the major face of plate-like water delivery member 44 provided with the water-delivery portions 48.

The plate-like water delivery member 44 is furthermore provided with an auxiliary water inlet which directly communicates with the water inlet of the water softening device 11 via a first additional internal water channel that preferably ends into the hydraulic connector 53 suited to couple with the water inlet of the same water softening device 11; and with an auxiliary water outlet which directly communicates with the water outlet of the water softening device 11 via a second additional internal water channel that preferably ends into the hydraulic connector 53 suited to couple with the water outlet of the same water softening device 11.

The auxiliary water inlet of plate-like water delivery member 44 is structured to directly couple with the fresh-water supply circuit 9 while bypassing the flow-diverter module 45, so as to receive from the fresh-water supply circuit 9 a flow of unsoftened fresh-water and channel said unsoftened fresh-water towards the water inlet of water softening device 11.

The auxiliary water outlet of plate-like water delivery member 44, in turn, is located at coupling socket 46, and is suitably structured to directly communicated with the main water inlet 51 of flow-diverter module 45, thus to channel a flow of softened fresh-water from the water outlet of water softening device 11 to the main water inlet 51 of flow-diverter module 45.

With reference to FIG. 6, the fresh-water supply circuit 9 of laundry washing machine 1, in turn, preferably comprises two independent electrically-operated on-off valves 54 and 55, each of which is separately connectable to the water mains. The electrically-operated on-off valve 54 is directly connected to the main water inlet 51 of flow-diverter module 45 via a first connecting hosepipe or manifold 56. The electrically-operated on-off valve 55 is directly connected to the auxiliary water inlet of plate-like water delivery member 44 via a second connecting hosepipe or manifold 57.

In the example shown, the fresh-water supply circuit 9 preferably finally comprises a further independent electrically-operated, on-off valve 58 which is separately connectable to a source of hot water (namely the hot branch of the piping, fittings, and fixtures involved in the distribution and use of water in the domestic building), and is directly connected to a second auxiliary water inlet of plate-like water delivery member 44 via a third connecting hosepipe or manifold 59.

Preferably this second auxiliary water inlet of plate-like water delivery member 44, in turn, directly communicates with the auxiliary water outlet of plate-like water delivery member 44 via a third additional internal water channel, thus to channel a flow of hot, unsoftened fresh-water towards the main water inlet 51 of flow-diverter module 45.

As an alternative, the second auxiliary water inlet of plate-like water delivery member 44 may also directly communicate with the water inlet of water softening device 11 or, better, with the hydraulic connector 53 suited to couple with the water inlet of the water softening device 11, thus to channel a flow of hot, unsoftened fresh water towards the water inlet of water softening device 11.

General operation of the laundry washing machine 1 is similar to that of the front loading washing machine disclosed in ELECTROLUX European patent No. 2554736, thus no other explanations are required.

The advantages resulting from the particular structure of detergent drawer 16 are remarkable. The upper lid assembly 23 prevents any accidental pouring of detergent, softener or other washing agent into the regeneration-agent compartment 20 during the refilling of the detergent, softener or other washing agents prior to the washing cycle.

More in detail, when trapdoor 25 is in the closed position (see FIG. 14), the upper lid assembly 23 prevents the user from accidentally pouring some detergent, softener or other washing agent into the regeneration-agent compartment 20. Furthermore, when trapdoor 25 is in the opened position (see FIG. 14) roughly above one or more of the detergent compartments 17, the lid assembly 23 prevents the user from accidentally pour some consumable salt (NaCl) or other regeneration agent into the detergent compartment/s 17 of detergent drawer 16

Furthermore the upper lid assembly 23 greatly simplifies the structure of the portion of plate-like water delivery member 44 located immediately above the regeneration-agent compartment 20, with a remarkable reduction of the plate-like water delivery member overall production costs.

Moreover the arrangement of the water-delivery portions 27 on the lower face of frame member 24, all around the central pass-through opening closed by trapdoor 25, allows a much more appropriate distribution of the water droplets inside the regeneration-agent compartment 20, thus improving formation of the brine.

Clearly, changes may be made to the laundry washing machine 1 without, however, departing from the scope of the present invention.

For example, according to a less-sophisticated embodiment, the drawer flush circuit 19 of detergent dispenser 7 may be structured to solely pour the fresh-water of the water mains selectively and alternatively into any one of the detergent compartments 17 of detergent drawer 16.

In this less-sophisticated embodiment, furthermore, the laundry washing machine 1 additionally comprises an auxiliary fresh-water supply line which is separately connected to the fresh-water supply circuit 9 or is separately connectable directly to the water mains, and is structured to selectively and independently channel, when detergent drawer 16 is placed in the retracted position, a flow of fresh water directly to the water inlet of the upper lid assembly 23 arranged/located on top of the regeneration-agent compartment 20.

In this embodiment, therefore, the upper lid assembly 23 receives the fresh water directly from said auxiliary fresh-water supply line bypassing the flow-diverter module 45 of detergent dispenser 7.

More in detail, the auxiliary fresh-water supply line is discrete from the drawer flush circuit 19, and may comprise a further electrically-operated, on-off valve which is separately connectable to the water mains; and a hosepipe directly connecting said further electrically-operated, on-off valve to the hydraulic connector 30 stationary inside drawer housing 18.

Rather than being incorporated into the plate-like water delivery member 44 of drawer flush circuit 19 so as to fluidically communicate with the flow-diverter module 45, the stationary second hydraulic connector 30 is therefore directly connected, via the hosepipe, to said further electrically-operated, on-off valve for selectively receiving the fresh-water of the water mains.

According to a not-shown, less sophisticated embodiment of drawer flush circuit 19, furthermore the electrically-operated, flow-diverter module 45 may be incorporated into the plate-like water delivery member 44 as disclosed in EP2562303.

Moreover, according to an alternative embodiment, the one or more detergent compartments 17 of detergent drawer 16 may be dimensioned to contain a given amount of detergent, softener or other washing agent sufficient for performing a number of washing cycles. Detergent drawer 16, furthermore, may optionally comprise, for each detergent compartment 17, a respective electrically-powered detergent feeding pump which is structured to selectively suck the dose of detergent, softener or other washing agent necessary to perform a washing cycle from the detergent compartment 17 and pump said dose of detergent, softener or other washing agent on the basin-shaped bottom portion 33 of drawer housing 18.

Figure 16:
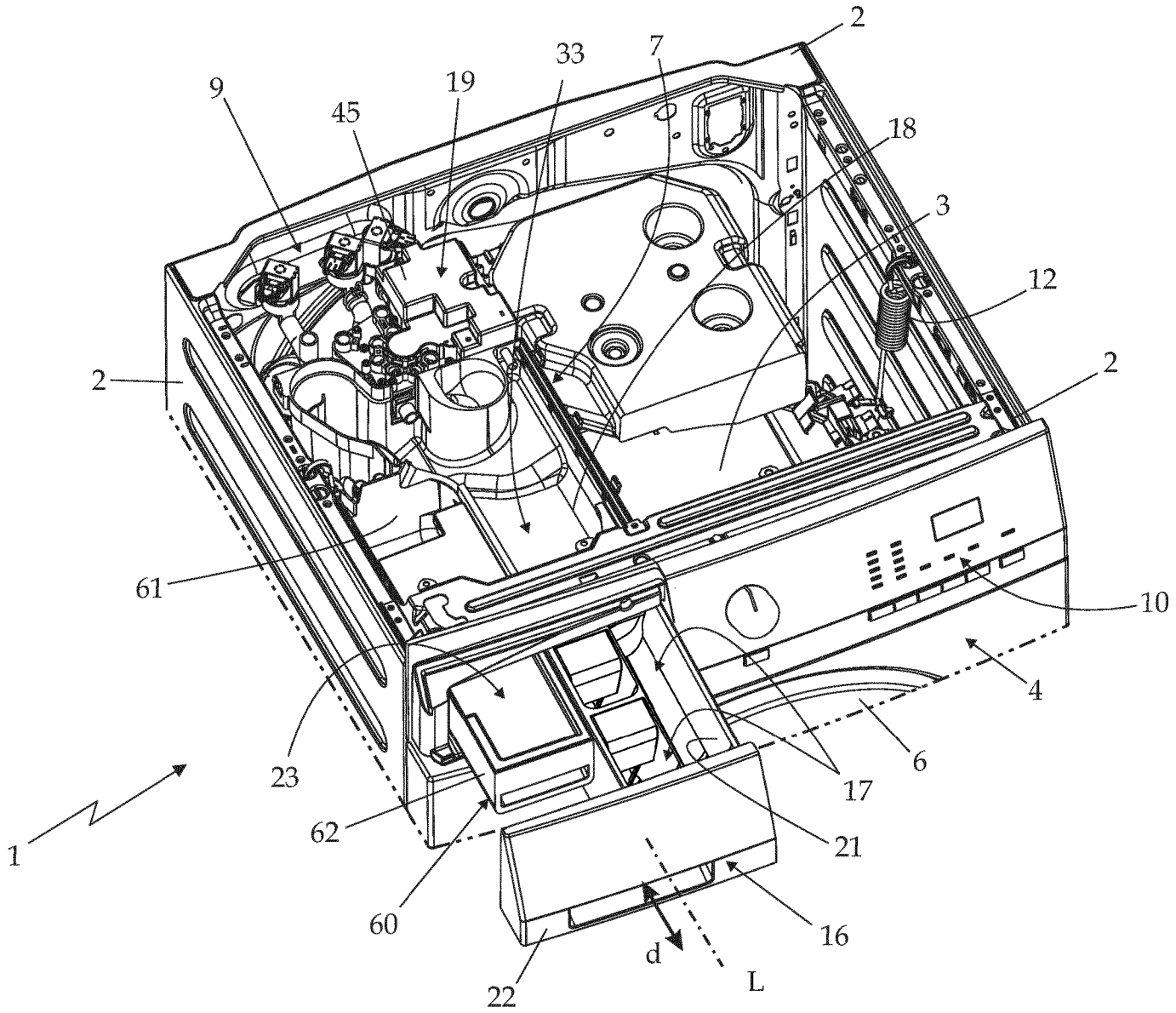
FIG. 16 is a perspective view of the top of a second embodiment of the FIG. 1 laundry washing machine, with parts removed for clarity.

Moreover, with reference to FIG. 16, in a further alternative embodiment the regeneration-agent compartment 20 is located into a supplementary, manually extractable, regeneration-agent drawer 60 which is discrete from detergent drawer 16, and is fitted/inserted in manually extractable manner into a corresponding substantially basin-shaped, drawer housing 61 which is located/recessed inside casing 2 horizontally beside detergent dispenser 7.

In other words, the regeneration-agent compartment 20 is formed into the drawer-like supporting structure 62 of regeneration-agent drawer 60, and the upper lid assembly 23 is arranged/located on the drawer-like supporting structure 62, on top of regeneration-agent compartment 20.

Alike detergent drawer 16, the regeneration-agent drawer 60 is movable in a substantially horizontally-oriented, displacement direction between:

- a retracted position in which the regeneration-agent drawer 60 is almost completely recessed into the front wall 4 of casing 2 and the regeneration-agent compartment 20 is inaccessible to the user; and
- a completely extracted position in which the regeneration-agent drawer 60 partly juts out from the front wall 4 of casing 2, so that the regeneration-agent compartment 20 is fully accessible to the user.

In this embodiment, the drawer housing 61 that accommodates regeneration-agent drawer 60 has its own basin-shaped bottom portion for receiving the brine dripping/falling down from the regeneration-agent compartment 20 through the large pass-through draining opening 37. Brine tank 36, if present, is firmly attach to the bottom of drawer housing 61 and is connected to the basin-shaped bottom portion of the same drawer housing 61 so as to allow the brine to freely flow by gravity from the drawer housing 61 directly into the same brine tank 36.

Hydraulic connector 30, in turn, is preferably now located stationary inside drawer housing 61, and the hydraulic connector 29 forming the water inlet 26 of upper lid assembly 23 preferably now protrudes from the back of regeneration-agent drawer 60 substantially parallel to the displacement direction d of regeneration-agent drawer 60, and is structured to substantially watertight couple in a stable, though easy detachable manner, with hydraulic connector 30 when regeneration-agent drawer 60 is placed in the retracted position.

In the example shown, furthermore, the drawer housing 61 of regeneration-agent drawer 60 is preferably realized in one piece with the drawer housing 18 of detergent drawer 16, and the plate-like water delivery member 44 of drawer flush circuit 19 is preferably structured to form the upper lid of both drawer housings 17 and 61. Detergent drawer 16 and regeneration-agent drawer 60 are therefore independently movable parallel and adjacent to one another, along a same substantially horizontally-oriented, displacement direction d which is locally substantially parallel to the longitudinal axis L of the drawer housings 17 and 61.

Preferably, even if the regeneration-agent compartment 20 is no more incorporated in the drawer-like supporting structure 21, the manually-sizable front panel 22 of detergent drawer 16 is still dimensioned to close, when detergent drawer 16 is placed in the retracted position, both the entrance of drawer housing 18 and the adjacent entrance of drawer housing 61. Thus axial displacement of regeneration-agent drawer 60 towards the completely extracted position is exclusively allowable when detergent drawer 16 is placed in the extracted position.

Moreover, according to a not-shown alternative embodiment of the upper lid assembly 23, the trapdoor 25 may be fitted in sliding manner on the upper face of frame member 24 so as to be able to slide horizontally, on top of the frame member 24, in a horizontal direction preferably locally substantially perpendicular to the longitudinal axis L of detergent drawer 16, i.e. perpendicular to the displacement direction d of detergent drawer 16.

Furthermore, according to a further not-shown alternative embodiment of the upper lid assembly 23, frame member 24 is missing and trapdoor 25 consists in a plate-like element which is substantially complementary in shape to the upper mouth of regeneration-agent compartment 20, and is laterally hinged directly to the drawer-like supporting structure 21, on top of the regeneration-agent compartment 20, so as to be able to rotate to and from a closing position in which said plate-like element is substantially coplanar to the upper rim of the regeneration-agent compartment 20 and closes the upper mouth of the regeneration-agent compartment 20.

In this embodiment, the plate-like element is preferably moreover provided with a water inlet which is faced to the outside of regeneration-agent compartment 20 and is suitably structured for receiving, when detergent drawer 16 is placed in the retracted position, the fresh-water from the drawer flush circuit 19; and with one or more water-delivery portions which are arranged on the lower face of the plate-like element, directly communicate with the water inlet of the plate-like element, and are finally suitably structured to allow the water entering into plate-like element through the water inlet to fall into the regeneration-agent compartment 20.

Lastly, in a not-shown alternative embodiment of laundry washing machine 1, the laundry loading/unloading opening is located on the upper worktop or top wall 8 of boxlike casing 2, and the washing tub 3 is arranged inside casing 2 with the mouth directly facing the upper worktop or top wall 8. The rotatable drum, in turn, is fitted vertically into washing tub 3 with the concavity facing the upper mouth of washing tub 3, so as to be able to rotate about a substantially vertically-oriented, longitudinal axis.

The invention claimed is:

1. A laundry washing machine comprising an outer casing and, inside said outer casing, a washing tub, a rotatable drum housed in an axially rotatable manner inside the washing tub and structured for housing laundry to be washed, a detergent dispenser structured for supplying detergent into the washing tub, a fresh-water supply circuit structured for selectively channelling a flow of fresh water from water mains towards the detergent dispenser and/or the washing tub, and an internal water softening device capable of reducing a hardness degree of the fresh water directed towards the detergent dispenser and/or the washing tub;

the laundry washing machine further comprising at least a first drawer which is fitted/inserted in an extractable manner into a corresponding drawer housing located/recessed inside the outer casing, and is movable in a displacement direction between a retracted position in which said first drawer is almost completely recessed into the outer casing, and an extracted position in which said first drawer partly juts out from the outer casing;

wherein said first drawer comprises: a drawer-like supporting structure having a substantially basin-shape, a regeneration-agent compartment structured for being manually fillable with a given amount of consumable salt or other regeneration agent; and a manually openable, upper lid assembly fitted on the drawer-like supporting structure to cover a substantial portion of an open mouth of the regeneration-agent compartment so as to move together in the displacement direction with said drawer-like supporting structure, wherein the upper lid assembly comprises: a frame member which is structured to fit to an upper rim of the regeneration-agent compartment, wherein the frame member is provided with a water inlet structured to receive the fresh water when the first drawer is in the retracted position, and with one or more water-delivery portions which are arranged on a lower side of the frame member and structured to allow an outflow of the fresh water from the frame member, and wherein the upper lid assembly is structured to selectively close/cover the upper mouth of said regeneration-agent compartment.

2. The laundry washing machine according to claim 1, wherein the entrance of said drawer housing is located on a first portion of a front wall of said outer casing, and in that the laundry washing machine additionally comprises an appliance control panel which is located on a second portion of said front wall substantially horizontally aligned beside said first portion.

3. The laundry washing machine according to claim 2, wherein said appliance control panel is stationary on said front wall.

4. The laundry washing machine according to claim 1, wherein said lid assembly is fitted on the drawer-like supporting structure, on top of the regeneration-agent compartment.

5. The laundry washing machine according to claim 1, wherein said lid assembly is structured to receive, at least when said first drawer is placed in the retracted position, a flow of fresh water and to channel said fresh water into the beneath-located regeneration-agent compartment.

6. The laundry washing machine according to claim 5, wherein said lid assembly is structured to spread out the received fresh water inside the regeneration-agent compartment.

7. The laundry washing machine according to claim 1, wherein said lid assembly is provided with a water inlet which is structured to allow the fresh water to enter into the same lid assembly, and with one or more water outlets which fluidically communicate with said water inlet and are structured to allow the water entering into the lid assembly through the water inlet to come out of the lid assembly and fall into the beneath-located regeneration-agent compartment.

8. The laundry washing machine according to claim 7, wherein by comprising a water-supply line which is structured to selectively channel, at least when said first drawer is placed in the retracted position, the fresh water of the water mains towards the water inlet of said lid assembly.

9. The laundry washing machine according to claim 8, wherein the water inlet of the lid assembly is structured to couple in detachable manner with said water-supply line when said first drawer is placed in the retracted position.

10. The laundry washing machine according to claim 9, wherein the water inlet of said lid assembly comprises a first hydraulic connector structured to couple in detachable manner with a complementary second hydraulic connector stationary inside the drawer housing when said first drawer is placed in the retracted position, and to uncouple from said second hydraulic connector when said first drawer moves into an extracted position; said complementary second hydraulic connector communicating with said water-supply line.

11. The laundry washing machine according to claim 1, wherein said lid assembly further comprises: a manually-movable trapdoor which is movably coupled to the frame member so as to selectively close a pass-through opening which is delimited by the frame member and is suitably shaped/dimensioned to allow the user to manually pour the consumable salt or other regeneration agent into the regeneration-agent compartment.

12. The laundry washing machine according to claim 11, wherein the water-delivery portions are arranged on a lower face of the frame member all around the pass-through opening closed by the trapdoor.

13. The laundry washing machine according to claim 1, wherein the water inlet of the frame member comprises a first hydraulic connector that extends substantially parallel to the displacement direction of the drawer, and is structured to couple in detachable manner, with a complementary second hydraulic connector which is located stationary inside the drawer housing so as to couple, when said first drawer is placed in the retracted position, with said first hydraulic connector.

14. The laundry washing machine according to claim 1, wherein the drawer-like supporting structure of the first drawer is additionally provided with one or more substantially basin-shaped, detergent compartments which are arranged beside the regeneration-agent compartment and are each structured for being manually fillable with a given amount of detergent, softener or other washing agent.

15. The laundry washing machine according to claim 14, wherein the detergent dispenser comprises a drawer flush circuit which is connected to the fresh-water supply circuit, and is structured for selectively pouring the fresh water of the water mains selectively into any one of the detergent compartments, so as to selectively flush the detergent, softener or other washing agent out of the same detergent compartment and down onto the bottom of the drawer housing.

16. The laundry washing machine according to claim 15, wherein the drawer flush circuit of the detergent dispenser is additionally structured for selectively channelling the fresh water of the water mains towards the water inlet of said lid assembly.

17. The laundry washing machine according to claim 16, wherein said lid assembly is structured to couple in detachable manner with the drawer flush circuit for receiving the fresh water of the water mains directly from the drawer flush circuit.

18. The laundry washing machine according to claim 15, wherein the drawer flush circuit of the detergent dispenser comprises: a water delivery member which is structured to form the upper lid of the drawer housing, so as to be located immediately above the detergent compartment/s and the regeneration-agent compartment when said first and/or second drawer/s is/are placed in the retracted position, and is provided with a number of water-delivery portions each suitably structured to allow the outflow of the water from the water delivery member towards the detergent compartment/s or the regeneration-agent compartment; and an electrically-operated, flow-diverter which is connected to the water softening device and/or to the fresh-water supply circuit for receiving the softened or unsoftened fresh water, and is suitably structured to selectively channel the softened fresh water arriving from the water softening device or the unsoftened fresh water arriving from the fresh-water supply circuit (9), towards any one of the water-delivery portions of the water delivery member.

19. The laundry washing machine according to claim 18, wherein one of the water-delivery portions of the water delivery member comprises the second hydraulic connector.

20. The laundry washing machine according to claim 1, wherein the detergent dispenser comprises a second drawer which is provided with one or more detergent compartments each structured for being manually fillable with a given amount of detergent, softener or other washing agent, and which is fitted/inserted in extractable manner into a corresponding second drawer housing which is located/recessed inside the outer casing horizontally beside the first drawer, and is movable in a displacement direction between a retracted position in which the second drawer is recessed into the outer casing, and an extracted position in which second drawer partly juts out from the outer casing to expose said detergent compartments.

21. The laundry washing machine according to claim 1, wherein the regeneration-agent compartment of the drawer is dimensioned to accommodate an amount of consumable salt or other regeneration agent sufficient for performing one or more regeneration processes of water softening capabilities of the internal water softening device.

22. The laundry washing machine according to claim 1, wherein the internal water softening device internally contains a given amount of ion-exchange resins capable of restraining the calcium and magnesium ions dissolved in the water that flows through the same water softening device.

* * * * *